US008059034B2

(12) United States Patent
Ly et al.

(10) Patent No.: US 8,059,034 B2
(45) Date of Patent: Nov. 15, 2011

(54) HIGH EFFICIENCY AND HIGH POWER PATCH ANTENNA AND METHOD OF USING

(75) Inventors: Canh Ly, Laurel, MD (US); Arthur C. Harrison, Rockville, MD (US)

(73) Assignee: The United States of America as resprented by the Secretary of the Army, Washington, DC (US)

( * ) Notice: Subject to any disclaimer, the term of this patent is extended or adjusted under 35 U.S.C. 154(b) by 319 days.

(21) Appl. No.: 12/397,126

(22) Filed: Mar. 3, 2009

(65) Prior Publication Data

US 2010/0022181 A1 Jan. 28, 2010

Related U.S. Application Data

(63) Continuation-in-part of application No. 12/178,771, filed on Jul. 24, 2008, now Pat. No. 7,692,592.

(51) Int. Cl.
*H01Q 1/38* (2006.01)

(52) U.S. Cl. ..... 343/700 MS; 343/825; 343/829; 343/848

(58) Field of Classification Search ..... 343/700 MS, 343/778, 846, 825, 829
See application file for complete search history.

(56) References Cited

U.S. PATENT DOCUMENTS

| | | | | |
|---|---|---|---|---|
| 5,841,401 | A * | 11/1998 | Bodley et al. | 343/700 MS |
| 6,067,053 | A * | 5/2000 | Runyon et al. | 343/797 |
| 6,181,281 | B1 | 1/2001 | Desclos et al. | |
| 6,208,298 | B1 * | 3/2001 | Uchino et al. | 343/700 MS |
| 6,292,143 | B1 | 9/2001 | Romanofsky | |
| 6,593,887 | B2 | 7/2003 | Luk et al. | |
| 6,697,019 | B1 | 2/2004 | Hyuk-Joon et al. | |
| 6,781,552 | B2 | 8/2004 | Tsai et al. | |
| 6,819,293 | B2 | 11/2004 | DeGraauw | |
| 7,064,713 | B2 | 6/2006 | Koenig | |
| 7,333,060 | B2 * | 2/2008 | Ando | 343/700 MS |
| 7,466,270 | B2 * | 12/2008 | Utagawa et al. | 343/700 MS |
| 7,884,764 | B2 * | 2/2011 | Itsuji | 343/700 MS |
| 7,889,134 | B2 * | 2/2011 | McKinzie et al. | 343/700 MS |
| 2003/0052783 | A1 * | 3/2003 | Sitzman | 340/572.7 |
| 2006/0092078 | A1 * | 5/2006 | Sanford | 343/700 MS |
| 2007/0052588 | A1 * | 3/2007 | Liu et al. | 343/700 MS |

(Continued)

OTHER PUBLICATIONS

W.F. Richards, Y.T. Lo, & D.D. Harrison, An Improvedtheory for Microstrip Antennas and Applications, IEEE Transactions on Antennas and Propagation, vol. AP-29, No. 1, Jan. 1981, pp. 38-46.

(Continued)

*Primary Examiner* — Hoang V Nguyen
(74) *Attorney, Agent, or Firm* — Lawrence E Anderson

(57) ABSTRACT

A patch antenna system and method comprising a base extending in a first plane; at least one patch mounted in a plane substantially parallel to the first plane; spaced from the base by at least one metallic post such that between the base and patch is substantially only gaseous fluid (which may be air). At least one power source may be operatively connected to the at least one patch for generation of electromagnetic waves at a center frequency of approximately 5.8 Gigahertz. The method of neutralizing unattended microwave devices comprises connecting a power source to a patch antenna and operating the patch antenna at a frequency in the range of approximately 3.89 to of 5.85 Gigahertz in the vicinity of a suspected unattended microwave device used to activate an explosive device to thereby jam any communication signal to the unattended microwave device and prevent the activation.

20 Claims, 22 Drawing Sheets

U.S. PATENT DOCUMENTS

2009/0079637 A1* 3/2009 Fukui et al. ..... 343/700 MS

OTHER PUBLICATIONS

Ly, Canh, "Functional Test Results of a High Power Patch Array Antenna," Army Research Laboratory ARL-TR-4352, AD-A475036 Defense Technical Information Center, published Dec. 27, 2007.

Weiss, S.J. et al., "An Efficient Patch Antenna With Bandwidth Enhancement," 2007 IEEE Antennas and Propagation Society International Symposium, 2007 IEEE, published Jun. 9-15, 2007, pp. 1529-1532.

W.R. Richards, et al. "An Improved Theory for Microstrip Antennas and Applications," IEEE Transactions on Antennas and Propagation, AP-29, pp. 113-116, Jan. 1981.

A.G. Demeryd, "A Theoretical Investigation of the Rectangular Microstrip Antenna Element," IEEE Trans. Antennas and Propagation, vol. AP-26, No. 4, pp. 532-535, Jul. 1978.

Y. T. Lo, D. Solomon, and W. F. Richards, "Theory and Experiments on Microstrip Antennas," IEEE Trans. Antennas and Propagation, vol. AP-27, No. 2, pp. 137-145, Mar. 1979.

I. J. Bahl and P. Bhartia, "Microstrip Antennas," Chapter 2, pp. 31-83, Artech House, Dedham, MA, 1980.

K. R. Carver and J. W. Mink, "Microstrip Antenna Technology," IEEE Trans. Antennas and Propagation, vol. AP-29, No. 1, pp. 2-24, Jan. 1981.

Y.T. Lo and S.W. Lee (Editors), "Antenna Handbook, Theory, Applications, and Design," Van Nostrand Reinhold Comp., New York, Chapter 10, pp. 10-1 to10-74, 1998.

S. Weiss and A. Leshchyshyn, "Anechoic Chamber Upgrade," Army Armament Research, Development and Engineering Center, ARAED-TR-95009, May 1995.

Wikipedia Encyclopedia, Patch Antenna, HTTP:/en.wikipedia.org/wiki/Patch_antenna, Jul. 29, 2008.

R. J. Mailloux, J.F. McIlvenna, N.P. Kernweis, "Microstrip antenna technology," IEEE Transactions on Antennas & Propagation, vol. 29, Jan. 1981, pp. 25-37.

* cited by examiner

Material: ALLOY 260 HALF-HARD BRASS, .125 inches thick; maximum flatness tolerance ± .0005 corner to corner

| HOLE | DIMENSIONS |
|---|---|
| A | 0.191D |
| B | 4-40 INTERNAL THREAD |
| C | 2-56 INTERNAL THREAD |
| D | 0.140D WITH 0.265D 100° CTSK |
| E | 0.161D |

Dimensions in inches; tolerance ±.002

Dimensions in inches; tolerance ±.002

Dimensions in inches; tolerance ±.002 tolerance ±.002

FIGURE 5 H-PLANE TWO-PATCH ANTENNA PATTERN AT C-BAND

FIGURE 6 E-PLANE TWO-PATCH ANTENNA PATTERN AT C-BAND 5.8 Gigahertz C-Band [$10^9$ Hz]

| HOLE | DIMENSIONS |
|---|---|
| A | 0.191D |
| B | 4-40 INTERNAL THREAD |
| C | 2-56 INTERNAL THREAD |
| D | 0.140D WITH 0.265D 100° CTSK |
| E | 0.161D |

DIMENSIONS IN INCHES
TOLERANCE ± .002

DIMENSIONS IN INCHES
TOLERANCE ± .002

DUROID TYPE 5880 .093
thick

HIGH EFFICIENCY AND HIGH POWER PATCH ANTENNA AND METHOD OF USING

STATEMENT OF GOVERNMENT INTEREST

The invention described herein may be manufactured, used, and licensed by or for the United States Government.

CROSS-REFERENCE TO RELATED APPLICATIONS

This application claims priority under 35 U.S.C. §120 to U.S. patent application Ser. No. 12/178,771, filed on Jul. 29, 2008, which is hereby incorporated by reference as though fully rewritten herein.

FIELD OF THE INVENTION

This invention relates broadly to antennas and more particularly to high power antennas operable at high frequencies.

BACKGROUND OF THE INVENTION

An antenna is an element used for radiating or receiving electromagnetic waves. While antennas are available in numerous different shapes and sizes, they all operate according to the same basic principles of electromagnetics. According to Faraday's law, the induced electromotive force or emf in any closed circuit is equal to the time rate of change of the magnetic flux through the circuit. Electromotive force, emf, measured in volts, refers to the energy gained per unit charge passing through a generating device. As used herein, the magnetic flux refers to the quantity of magnetism, or the strength of a given magnetic field, given by the equation:

$$\mathcal{E} = -\frac{d\Phi_B}{dt}.$$

where $\in$ is the electromotive force (EMF) in volts $\Phi_B$ is the magnetic flux through the circuit (in webers).

The direction of the electromotive force (the negative sign in the above formula) is given by Lenz's law.

As a general principle, a guided wave traveling along a transmission line in an antenna will radiate free-space waves also known as electromagnetic waves. Conversely, when an antenna is receiving, it transforms free-space waves by inducing a guided electromagnetic wave within a transmission line. The guided electromagnetic waves are fed into a circuit, which converts them into a useful format.

When an antenna is transmitting, it receives the guided electromagnetic wave for transmission from a feed line and induces an electric field surrounding the antenna to form a free-space propagating electromagnetic wave. The features of an antenna can be described by parameters of operation such as frequency, radiation patterns, reflected loss, and gain.

An antenna may be a component of a device such as, for example, a cellular telephone, radio, television, or RADAR system that directs incoming and outgoing radio waves between free space and a transmission line. Antennas may be composed of metal or polymers filled with metal or carbonaceous particles and have a wide variety of configurations, from the whip or mast-like devices employed for radio and television broadcasting to the large parabolic reflectors used to receive satellite signals and the radio waves generated by distant astronomical objects.

Many types of portable electronic devices, such as cellular phones, GPS receivers, palm electronic devices, pagers, laptop computers, and telematics units in vehicles, need an effective and efficient antenna for communicating wirelessly with other fixed or mobile communication units, including satellites. Advances in digital and radio electronics have resulted in the production of a new class of personal communications equipment posing special problems for antenna designers.

Personal wireless communication devices have created an increased demand for compact antennas. The increase in satellite communication has also increased the demand for antennas that are compact and provide reliable transmission. In addition, the expansion of wireless local area has also necessitated the demand for antennas that are compact and inexpensive.

Wire antennas, such as whips and helical antennas, are sensitive to only one polarization direction. As a result, they are not optimal for use in portable communication devices which require robust communications even if the device is oriented such that the antenna is not aligned with a dominant polarization mode.

A patch antenna is a type of antenna that offers a low profile and easy manufacturability, great advantages over traditional antennas. Patch antennas are planar antennas used in wireless links and other microwave applications. Generally, conventional patch antennas use "patches" formed on the top surface of a thin dielectric substrate separating them from a conductive layer on the bottom surface of the substrate that constitutes a ground for the transmission line or antenna.

Reflector or dish antennas are commonly used in residential environments for receiving broadcast services, such as television channel signals from geostationary, or equatorial, satellites. Reflector antennas, however, are bulky and relatively expensive for residential use. Furthermore, inherent in reflector antennas are feed spillover and aperture blockage by a feed assembly, which significantly reduces their aperture efficiency. An alternative antenna, such as a patch antenna, overcomes many of the disadvantages associated with reflector antennas.

Patch antennas require less space, are simpler and less expensive to manufacture, and are more compatible than reflector antennas. A parabolic reflector antenna has a curved surface. A patch antenna can be made having a planar surface. Further, a patch antenna can achieve the concentration of an antenna beam in a particular direction by means of the application of one of several methods.

Patch antennas are particularly suitable for use as active antennas. An active antenna is an antenna having all of the necessary components, such as an antenna element, feeding circuits, active devices or active circuits, integrally provided on a monolithic substrate, thus producing compact, low cost, and multi-function antenna equipment.

Additionally, the planar structure of a patch antenna permits it to be conformed to a variety of surfaces having different shapes. Patch antennas can be designed to produce a wide variety of patterns and polarizations, depending on the mode excited and the particular shape of the radiating element used. This results in the patch antenna being applicable to many military and commercial devices, such as, for example, use on aircraft or space antennas.

There is an increasing demand for the use of patch antennas in wireless communication due to their inherently low back radiation, ease of conformity and high gain as compared to wire antennas. The patch antenna design prevents large amounts of radiation from being produced at the back of the antenna.

Patch antennas comprise one or more conductive rectilinear or ellipsoidal patches supported relative to a ground plane and radiate in a direction substantially perpendicular to the ground plane. As opposed to a conventional wire-based antenna, generally the conventional patch antenna comprises a plurality of generally planar layers including a radiating element, an intermediate dielectric layer, and a ground plane layer. The radiating element is an electrically conductive material imbedded or photo etched on the intermediate layer and is generally exposed to free space.

Depending on the characteristics of the transmitted electromagnetic energy desired, the radiating element may be square, rectangular, triangular, or circular and is separated from the ground plane layer. An exemplary conventional patch antenna may include a transmission line feed, multiple dielectrics, and a metalized patch on one of the dielectrics. In a typical conventional patch antenna, the radiator element is provided by a metallic patch that is fabricated onto a dielectric substrate over a ground plane.

The conventional dual-band signal-layer patch antenna has been widely used in applications like radar and communication systems because of its advantages over a conventional antenna, such as lighter weight, lower profile and lower cost. Generally, dual-band single-layer patch antennas can be categorized into categories which include stub-type patch antennas, notch-type patch antennas, pin-and-capacitor-type patch antennas, and slot-loaded-type patch antennas.

The patch antenna has a very low profile and can be fabricated using photolithographic techniques. It is easily fabricated into linear or planar arrays and readily integrated with microwave integrated circuits. Patch antennas are commonly produced in half wavelength sizes, in which there are two primary radiating edges parallel to one another.

The performance of an antenna is determined by several parameters, one of which is efficiency. For a patch antenna, "efficiency," as used herein, is defined as the power radiated divided by the power received by the input to the antenna. A one-hundred percent efficient antenna has zero power loss between the received power input and the radiated power output. Factors that determine patch antenna efficiency include the loss in the dielectric material, the surface wave loss, and conduction losses. Traditional patch antennas, designed with a dielectric material, have about 80% efficiency. For example, if the patch array antenna, designed on the dielectric, is excited with an input power of 1 kilowatt (KW), the antenna will radiate 800 watts (W) while 200 W are lost.

Patch array antennas typically rely on traveling waves and require a complex feed network which contributes significant feed loss to the overall antenna loss. Furthermore, many patch antennas are limited to transmitting and/or receiving only a linearly polarized beam. The substrate is mounted on a larger ground plane, which serves as the return path for current induced on the patch element.

A patch antenna operates by resonating at a frequency. The patch antenna performs optimally when it is sized such that the cavity beneath the patch resonates in its fundamental mode at the frequency of interest.

Microstrip antennas and patch array antennas have been developed over many decades because of their low profile structures. These antennas are often designed on dielectric materials and can have reduced efficiency owing to dielectric losses As stated in the foregoing, in view of the deficiencies of the prior art, there exists a need for a more efficient, low-cost, high power antenna system operable at high frequencies.

The publication entitled "*Functional Test Results of a High Power Patch Array Antenna,*" Ly, Canh; January 2008; Report No.(s): AD-A475036; ARL-TR-4352; Defense Technical Information Center (DTIC), discloses mechanical and electrical test results of a high power two-patch array antenna. The mechanical test was run for 55 minutes for each axis of the antenna. The electrical test was conducted using a high power RF source (>1 KW) with single and two-patch array antennas. Although the first mechanical test results indicated that the screws of the antenna cover are loosened about ¼ turn, and right angle connectors inside the antenna enclosure box were loosened about a fraction of a turn, the antenna still sustained all functional operations. The antenna uses air dielectric to endure a high average power for the system that operates at S-Band in order to neutralize unattended microwave devices.

SUMMARY OF INVENTION

A preferred embodiment of the present invention comprises a C-Band, probe-fed, half-wave length, two-patch antenna array. The array is low profile in construction, but maintains the ability to transmit high power RF efficiently. The antenna is supported in free space by metallic posts rather than by a dielectric material. Conventional patch arrays designed with dielectric substrates are about 80% efficient based on the loss in dielectric material, the surface wave losses, and conductor losses. For example, if the patch array antenna, designed with dielectric material, is excited with an input power of 1 kW, the antenna will radiate 800 W while 200 W must be dissipated by the antenna itself as heat. In contrast, the high power two-patch antenna array, designed using an air dielectric, has very high efficiency (on the order of 97%). As such, only 30 W is dissipated within the antenna structure, primarily due to ohmic losses. In addition to the superior efficiency, a preferred embodiment antenna has a bandwidth of more than three times the bandwidth of a normal patch array at 5.8 GHz center frequency. A preferred embodiment antenna offers a low-profile, light-weight and low-cost solution, has great potential as an integrated antenna array for high power microwave (HPM) applications. Since the antenna has its own ground plane, it will not be sensitive to nearby metal structures when installed on a host platform. An objective of the present invention is the design a low profile, low cost, and light-weight antenna with similar electrical performance in terms of beamwidth, coverage and gain compared to current sectoral horn antennas.

A preferred embodiment of the present invention comprises a patch antenna constructed with supporting posts. A unique feature is the absence of a dielectric layer between the patch and the ground plane. As such, this construction precludes the excitement of surface waves increasing the efficiency of the antenna. It was experimentally discovered metallic supports (as compared to dielectric supports) appreciably increased the bandwidth of the antenna. The placement of the supports assumed a simple cavity model estimation of the currents and was validated by measurements and computer simulations. A probe is used as the mechanism to excite the patch. The antenna may be excited by a high power source and measured with a power meter in a chamber; resulting in a measured performance that is equivalent to a larger more visible horn antenna. The antenna's architecture is low profile and suitable for platform integration. The design is unique, reproducible, and affordable for manufacturing.

The preferred embodiment antenna may be used, for example, for high power microwave applications. The two-metal patch embodiment comprises an air dielectric between the patch and ground plane. The two-metal patches may have coaxial feeds with, for example, type N connectors and may be supported by two metal posts positioned for bandwidth enhancement. The array can produce a maximum achievable gain of 11.5 dBi and a bandwidth of 957 MHz (17% bandwidth) referenced to the center frequency of 5.8 GHz.

These and other aspects of the embodiments of the invention will be better appreciated and understood when considered in conjunction with the following description and the accompanying drawings. It should be understood, however, that the following descriptions, while indicating preferred embodiments of the invention and numerous specific details thereof, are given by way of illustration and not of limitation. Many changes and modifications may be made within the scope of the embodiments of the invention without departing from the spirit thereof, and the embodiments of the invention include all such modifications.

BRIEF DESCRIPTION OF THE DRAWINGS

FIG. 3 comprises a series of illustrations of some of the components of a two-patch antenna embodiment. FIG. 3 comprises FIGS. 3*a*, 3*b*, and 3*c*. FIG. 3*d*-1 is a schematic illustration of, inter alia, the N connector attachment to base 1. FIG. 3*d*-2 is a schematic illustration of, inter alia, the patch 6 to base 1 mounting subassembly and cover 2 to base 1 mounting subassembly.

FIG. 5 shows radiation patterns in H-plane of a preferred embodiment two-patch array antenna with measured performance at 5.8 GHz compared to the model results using FEKO (www.feko.info), EM simulation software

FIG. 9 is a series of illustrations of some of the components of a one-patch antenna embodiment. FIG. 9 consists of FIGS. 9*a*, 9*b*, and 9*c*. FIG. 9*d*-2 is a schematic illustration of, inter alia, the patch 6 to base 1 mounting subassembly and cover 2 to base 1 mounting subassembly.

Figure 1:
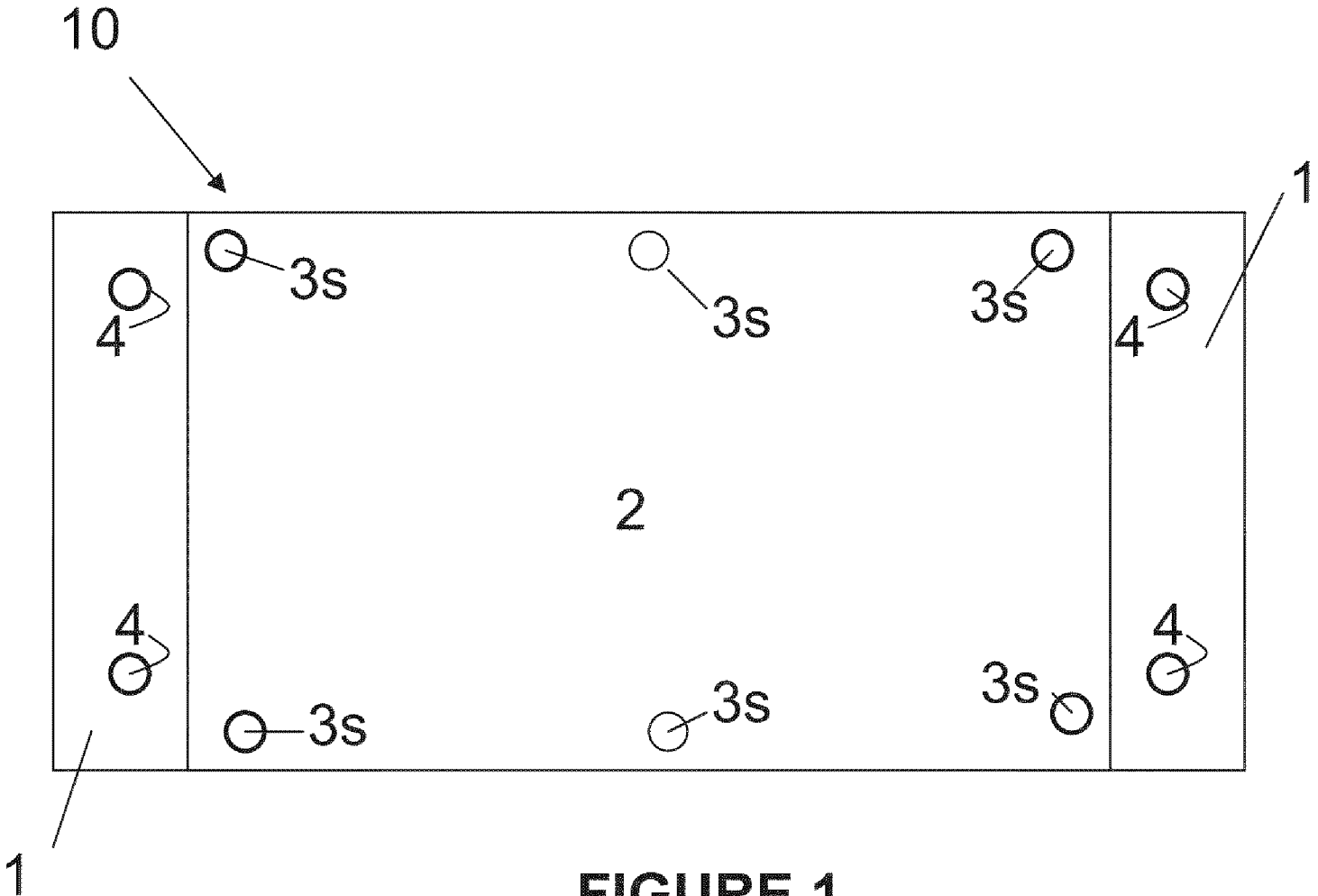
FIG. 1 is a front view of a two-patch antenna embodiment of the present invention.

A more complete appreciation of the invention will be readily obtained by reference to the following Description of the Preferred Embodiments and the accompanying drawings in which like numerals in different figures represent the same or corresponding structures or elements. Similar functioning elements are represented using a suffix such as 3A, 3B, or 3C. The representations in each of the figures are diagrammatic and no attempt is made to indicate actual scales or precise ratios. Proportional relationships are shown as approximates.

DESCRIPTION OF PREFERRED EMBODIMENTS

The embodiments of the invention and the various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the embodiments of the invention. The examples used herein are intended merely to facilitate an understanding of ways in which the embodiments of the invention may be practiced and to further enable those of skilled in the art to practice the embodiments of the invention. Accordingly, the examples should not be construed as limiting the scope of the embodiments of the invention.

The terminology used herein is for the purpose of describing particular embodiments only and is not intended to limit the full scope of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element such as an object, layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that, although the terms first, second, etc. may be used herein to describe various elements, components, regions, layers and/or sections, these elements, components, regions, layers and/or sections should not be limited by these terms. For example, when referring first and second photons in a photon pair, these terms are only used to distinguish one element, component, region, layer or section from another region, layer or section. Thus, a first element, component, region, layer or section discussed below could be termed a second element, component, region, layer or section without departing from the teachings of the present invention.

Furthermore, relative terms, such as "lower" or "bottom" and "upper" or "top," may be used herein to describe one element's relationship to other elements as illustrated in the Figures. It will be understood that relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below. Furthermore, the term "outer" may be used to refer to a surface and/or layer that is farthest away from a substrate.

Embodiments of the present invention are described herein with reference to cross-section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region or object illustrated as a rectangular will, typically, have tapered, rounded or curved features. Thus, the regions illustrated in the figures are schematic in nature and their shapes are not intended to illustrate the precise shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will also be appreciated by those of skill in the art that references to a structure or feature that is disposed "adjacent" another feature may have portions that overlap or underlie the adjacent feature.

Figure 2:
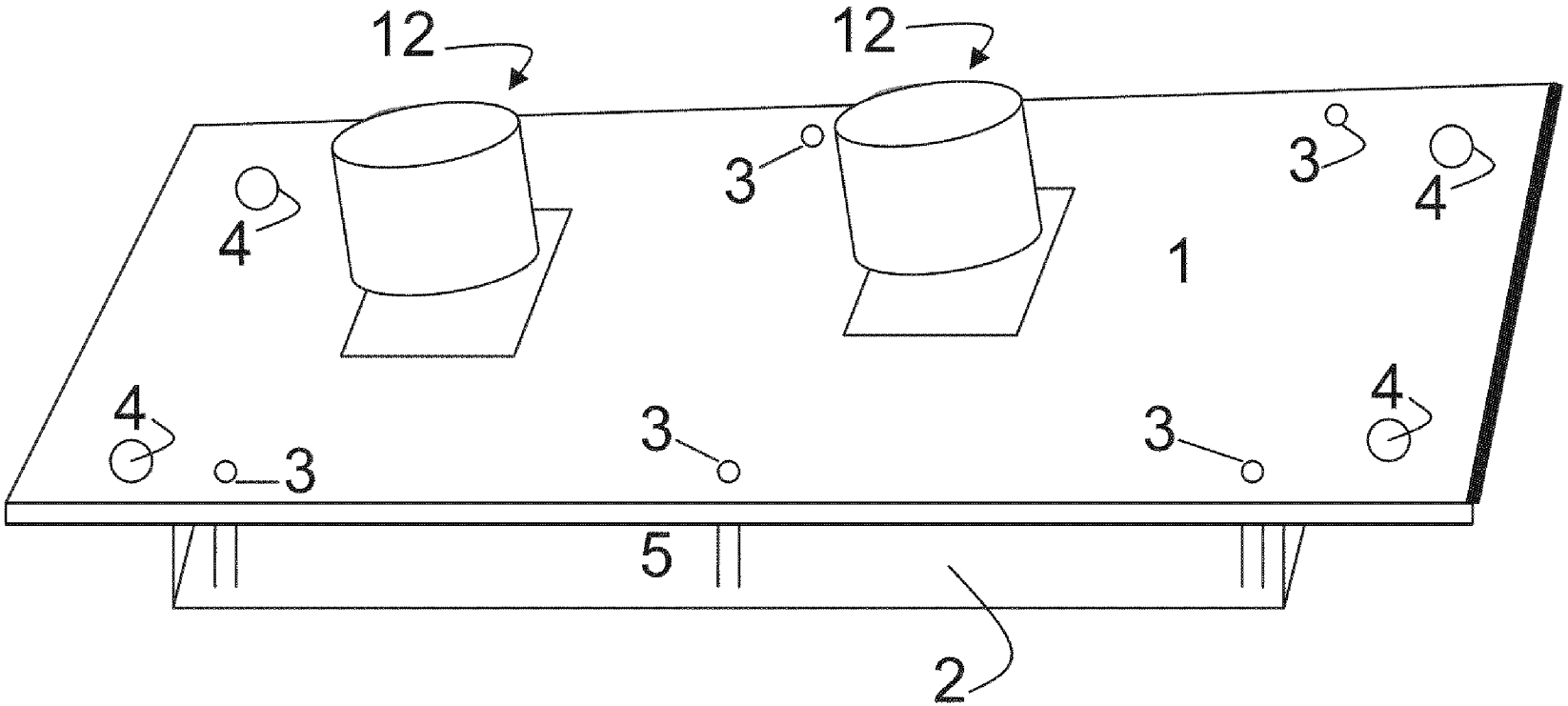
FIG. 2 is a side back view of a two-patch antenna embodiment of the present invention.

FIGS. 1-3 illustrate a preferred embodiment of the present invention wherein is described a new unique and elegant, low-profile and high power dual—C-band antenna with a two patch configuration (two-patch array antenna system) which may, for example, operate at two frequencies—3.89 GHz and 5.85 GHz.

Figure 3C:
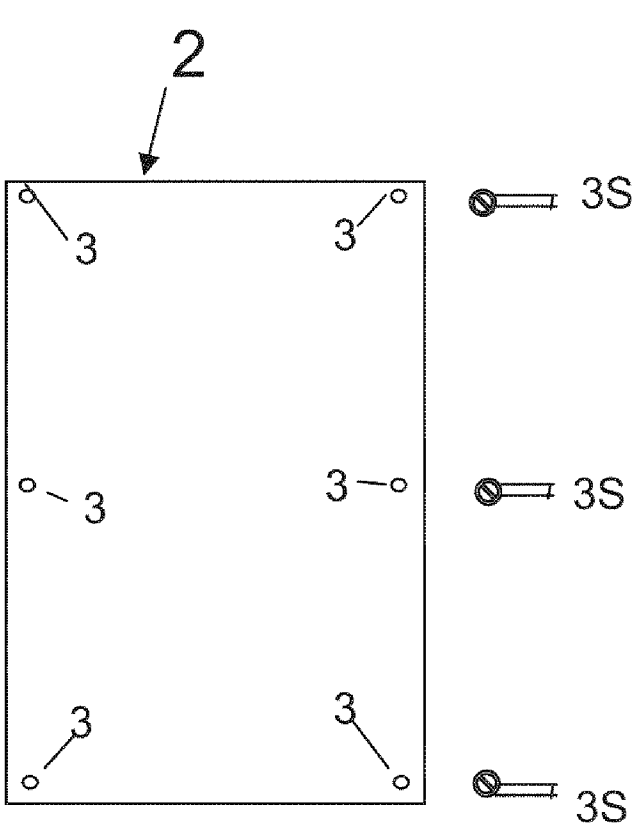
FIG. 3*c* illustrates the antenna cover 2. The detailed dimensions of the cover 2 are shown in FIG. 3*c*-1.

FIG. 1 illustrates the front view of a preferred embodiment 10 of the present invention. The preferred embodiment antenna 10 comprises a ground plane base plate 1 which may be, for example, brass. The antenna cover 2 may be secured by means of antenna securing retainers 3, which may be black nylon fasteners 3*s* as shown in FIG. 3*c*. The base plate 1 comprises mounting holes 4. Mounting holes 4 may be utilized to mount the assembly 10 to vehicles and other suitable platforms. The base plate 1 further comprises solder connectors 8 for the pin feeds (approximately 52 mils in diameter) located approximately 0.0845 inches from the patch edge. The pin feed is on the center line of the longer line (or long length as illustrated in FIG. 3*a*-2) of the patch 6. As sown in FIG. 3*a*, the ground plane base plate 1 supports two patches 6 which are separated by $\lambda_0$ with metal standoffs (0.086 inches in diameter). Each individual patch is supported by two metal posts 7 located 0.0634 inches from the edge and excited by a pin-fed probe (shown at 8 in FIG. 3*a*). The metal posts 7 are on the center line of the shorter edge of the patch.

FIG. 2 illustrates a back view of the preferred embodiment of FIG. 1. Although the holes 3 of spacer 5 are shown in FIG. 2, the spacer 5 may be a continuous sheet placed between the cover 2 and the antenna ground plane base 1. Spacer 5 may be, for example, approximately 0.25 inch clear polycarbonate such as Lexan®. The height of the plastic spacer 5 may be adjusted to minimize the loading effects of the dielectric cover on the patches. The height is also is used to tune the resonant frequency of the antenna. The distances in length and width between the patches to the walls of the spacer were experimentally determined to obtain optimal performance. The optimum width of the spacer was determined to be approximately 0.250 inches. The detailed dimensions of the spacer are shown in Table 1.

The antenna cover 2 may be fabricated of Duroid® material (RT 5880) and has six black nylon screws 3*s* which are used to secure it to the base plate. The detailed dimensions of the cover are shown in Table 1. FIG. 2 shows the side back view of the antenna including two type N connectors 12 that will be integrated with an RF power divider that is connected the source (>1 Kilowatt in power). FIG. 3 shows the detail assembly antenna architecture. This figure consists of FIGS. 3*a*, 3*b* and 3*c*. Each dimension shown in FIGS. 3*a*-3*d*, including subparts of the Figures, has a tolerance or range of plus or minus one sixteenth of an inch.

FIGS. 3*a* and 3*a*-1 depict the ground plane (base plate) 1 with four big mounting holes 4, six small holes 3 that are used to secure the antenna cover 2, and dimensions of two type N connectors 12. This ground plane base plate 1 of FIG. 3*a*-1 supports two patches 6 which are separated by one lambda λ—Lambda λ being the operating wavelength of the system. Each individual patch is supported by two metal posts 7 and excited by a pin-feed probe connected at 8 as shown in FIG. 3*d*-1. The detailed dimensions for the ground plane and the patch are shown in FIGS. 3*a*.1 and 3*a*.2.

Figure 3B:
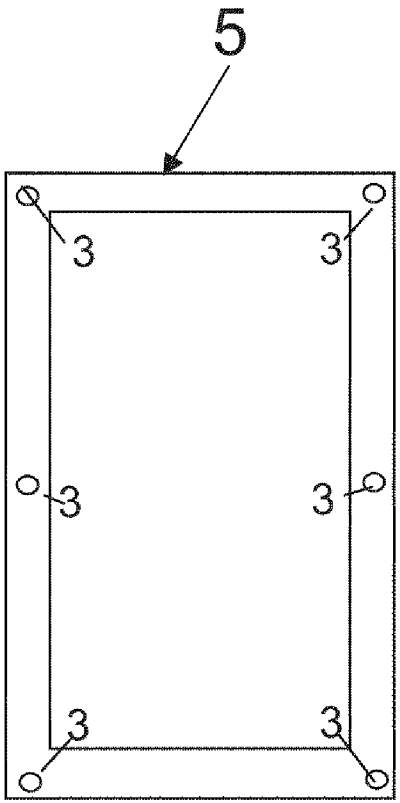
FIG. 3*b* illustrates the spacer 5. The detailed dimensions of the spacer 5 are shown in FIG. 3*b*-1.
Figure 3A:
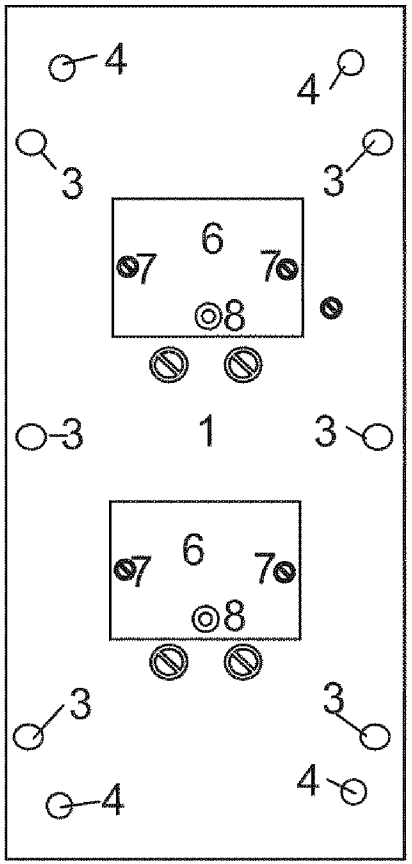
FIG. 3*a* depicts the ground plane (base plate) 1. The detailed dimensions for the ground plane base 1 and the patch 2 are shown in FIGS. 3*a*-1 and 3*a*-2, respectively.
Figures 1, 3A:
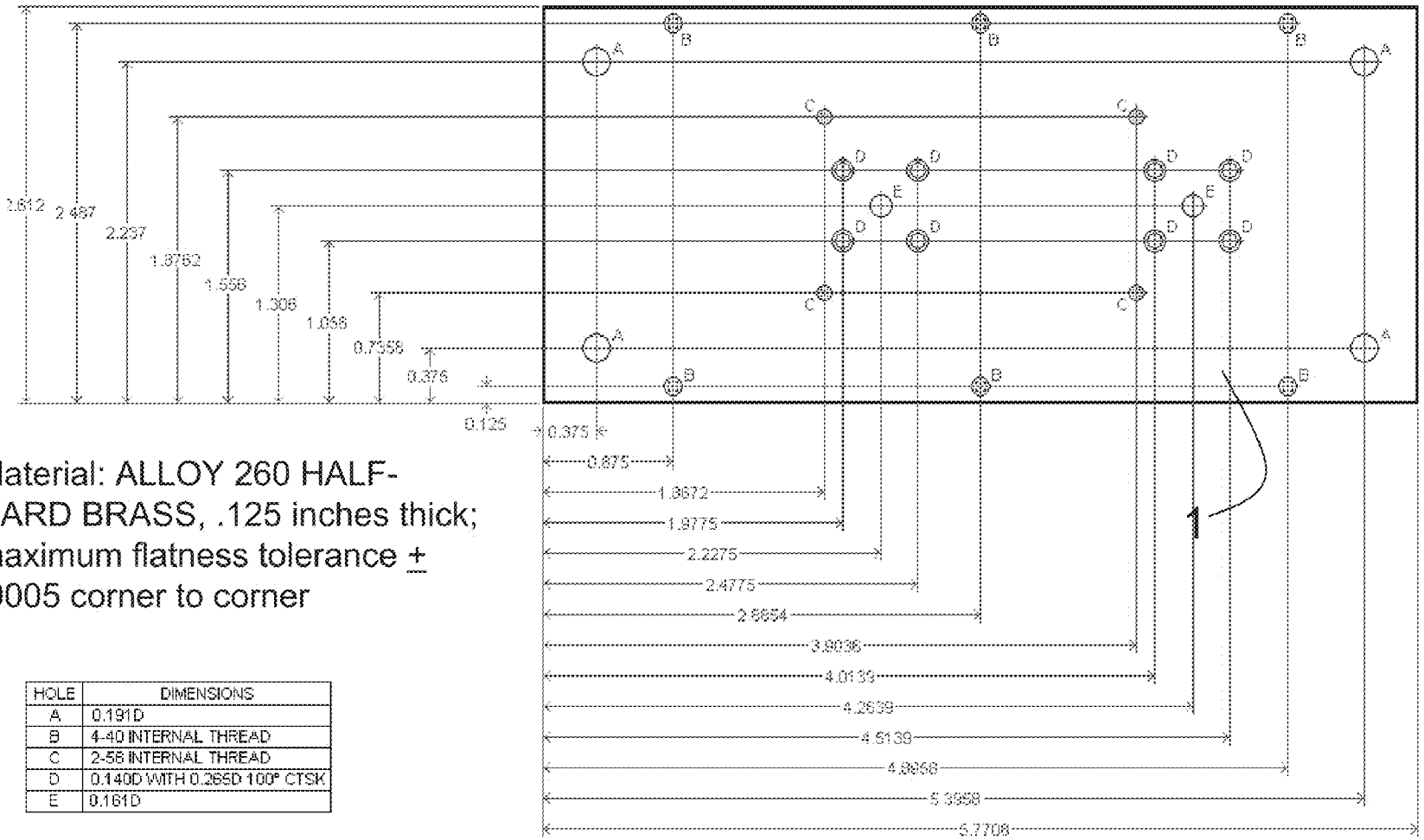
Figures 2, 3A:
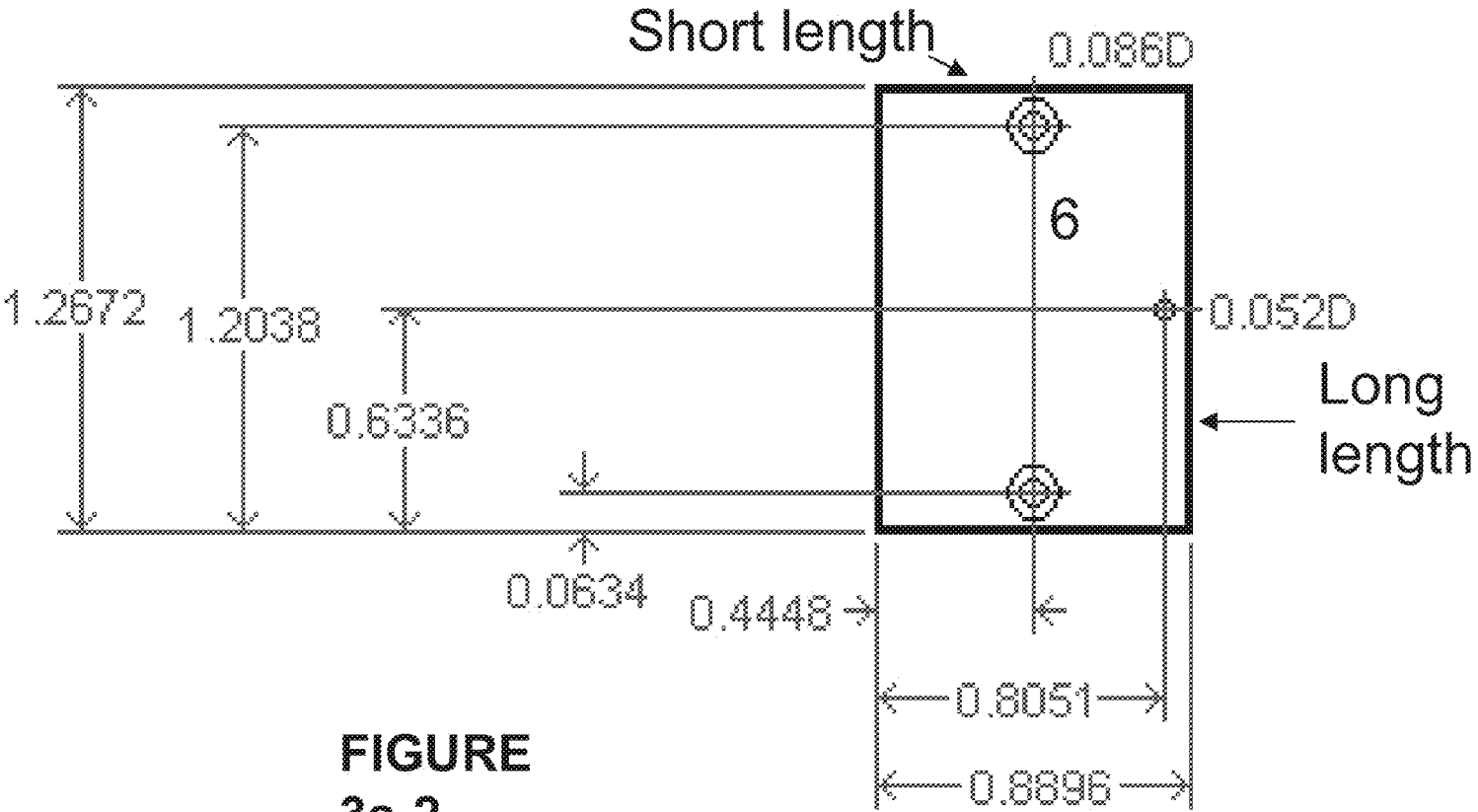
Figures 1, 3B:
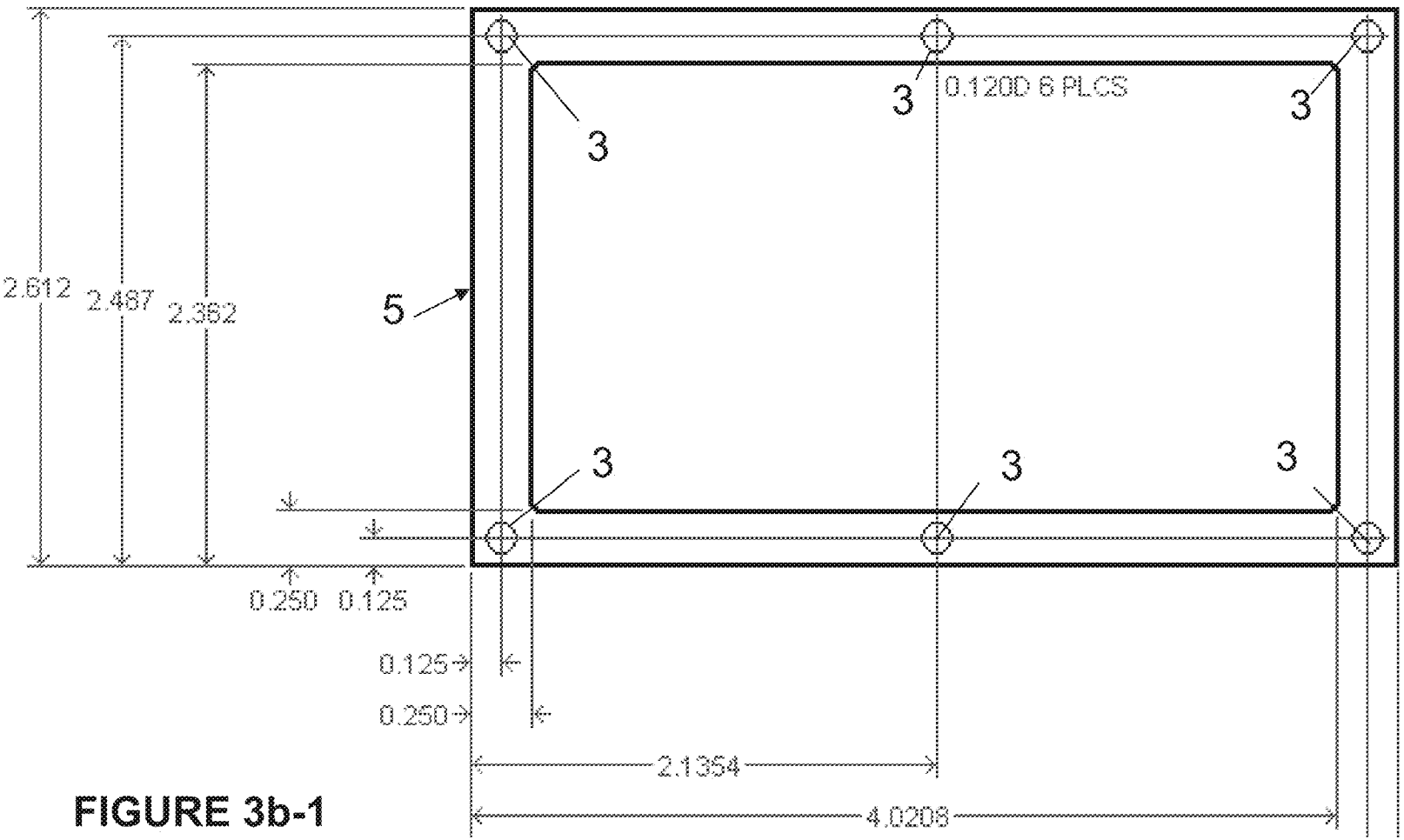
Figures 1, 3C:
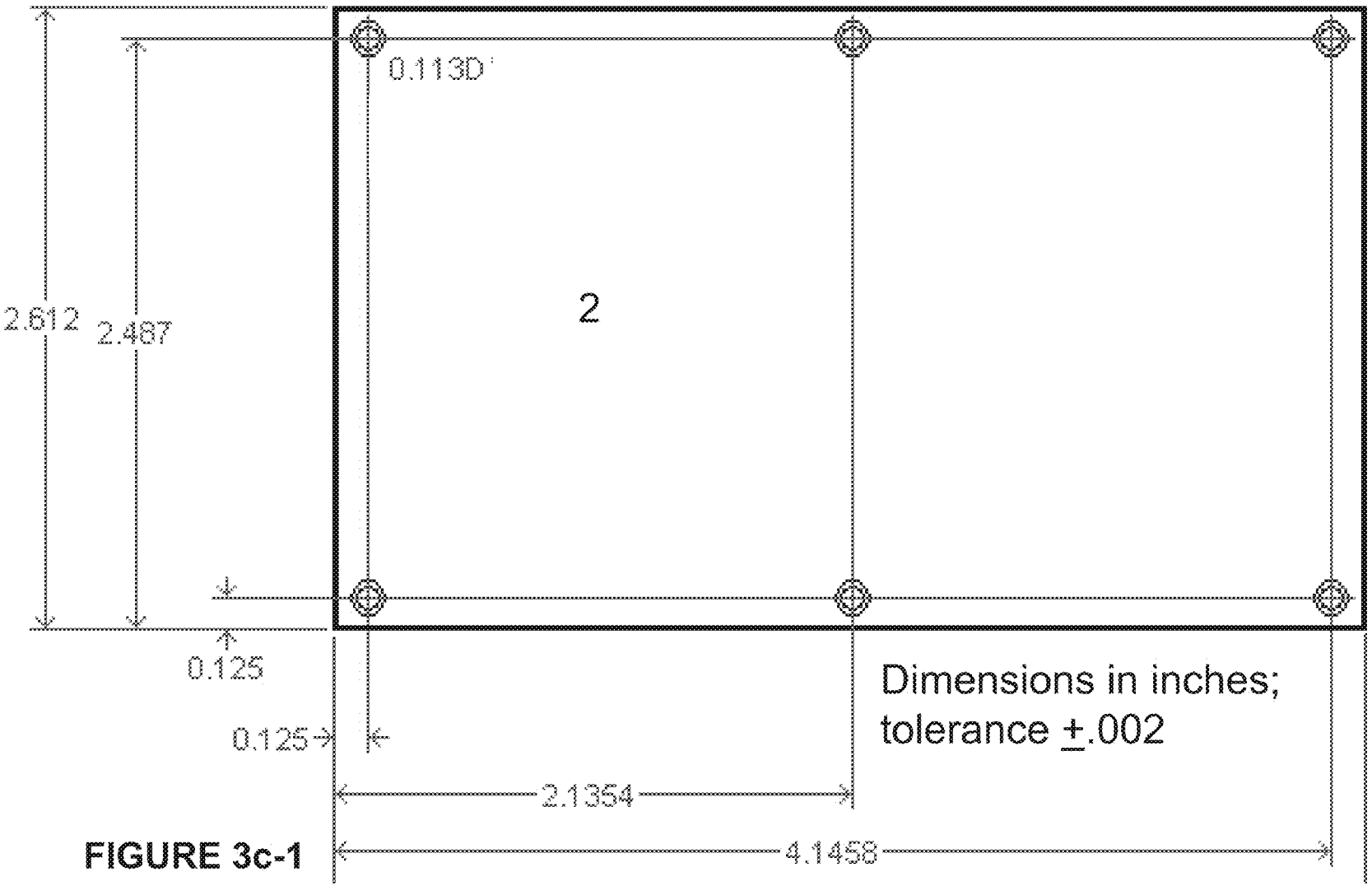
Figures 1, 3D:
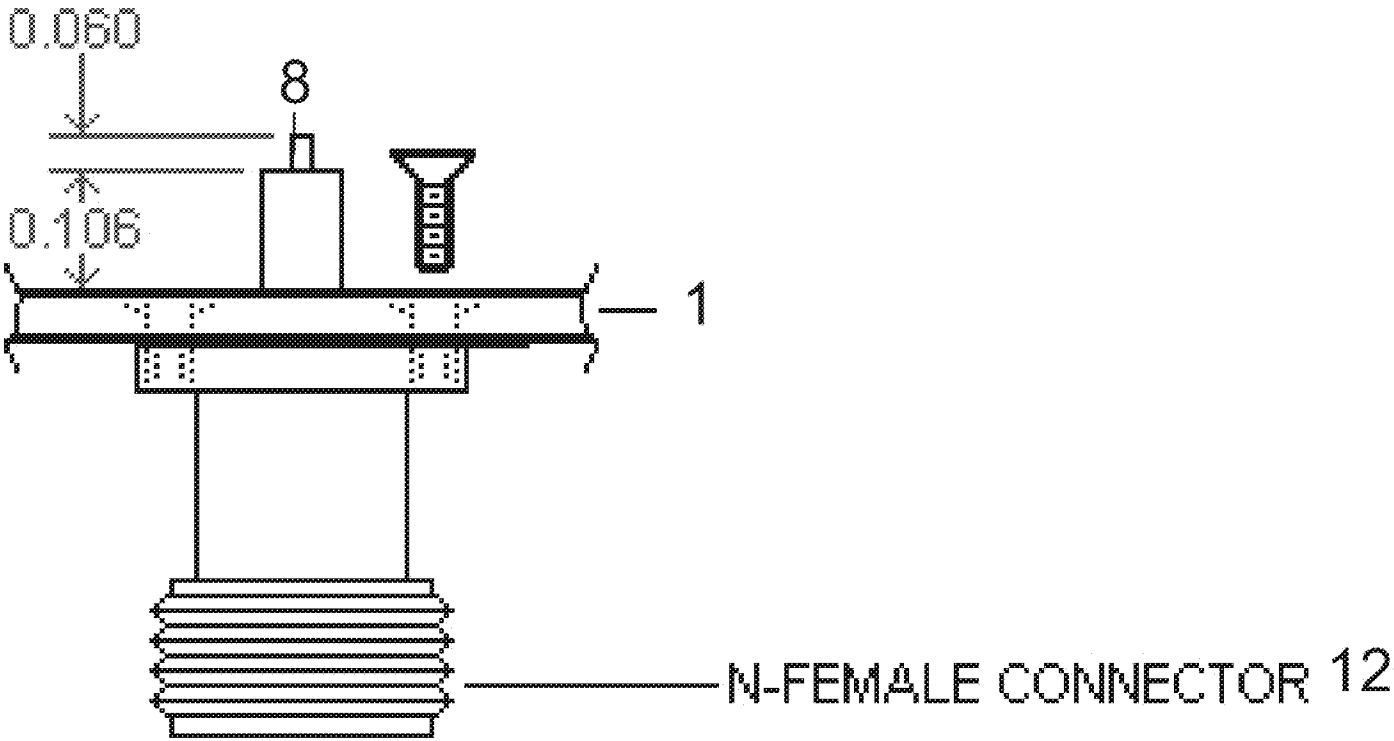
Figure 3D:
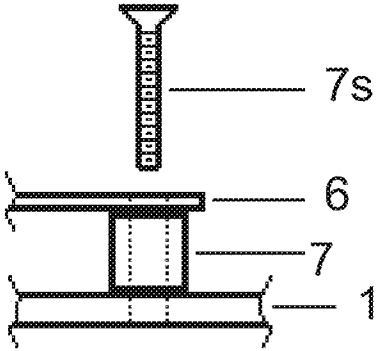
Figure 2:
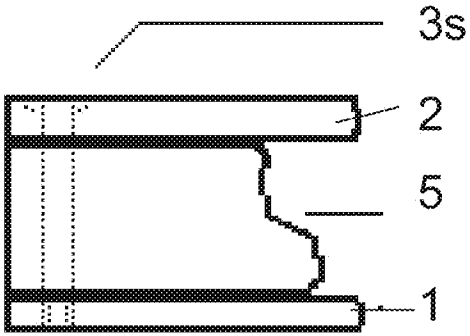

FIG. 3*b* illustrates a spacer 5 which may be, for example, ¼ (0.25) inch and made of Lexan. The spacer 5 may be placed between the cover 2 and the ground antenna plane base plate 1 as shown in FIG. 3*d*-2. The height of the plastic spacer 5 may be adjusted to minimize the loading effects of the dielectric cover on the patches 6. The adjustment may also be of use in tuning the resonant frequency of the antenna 10. The distances in length and width between the patches to the walls of the spacer were experimentally determined to obtain optimal performance. The detailed dimensions of the spacer are shown in FIG. 3*b*-1

FIG. 3*c*-1 illustrates the antenna 2 cover which may be made of Duroid® material (RT 5880), which may be secured by six black nylon screws 3*s* (not shown). The detailed dimensions of the cover are shown in FIG. 3*c*-1.

Figure 9C:
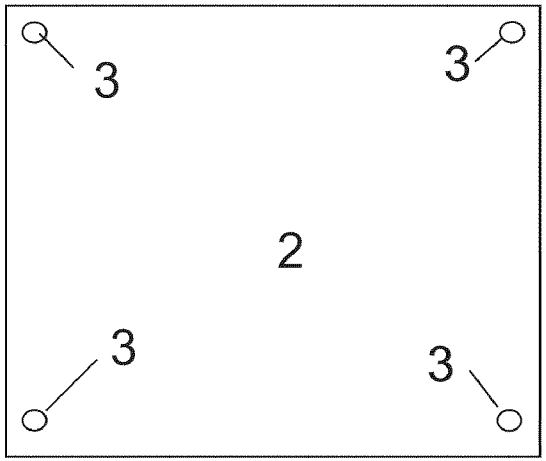
FIG. 9*c* shows the antenna cover 2. The detailed dimensions of the cover are shown in FIG. 9*c*-1.
Figure 9B:
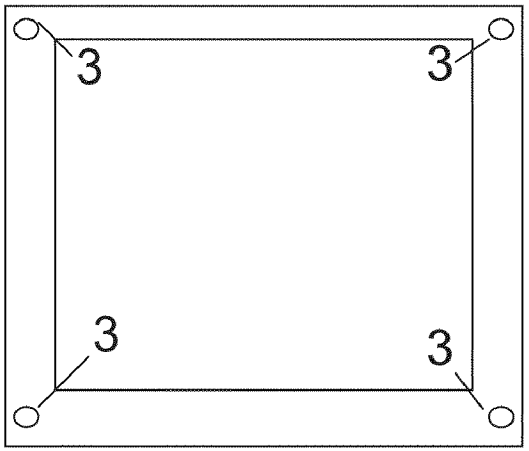
FIG. 9*b* illustrates a spacer 5, which may for example be made of Lexan® which is inserted between cover 2 and the ground antenna plane base 1. The detailed dimensions of the spacer are shown in 9*b*-1.

The dimensions in Table 1 are used to construct a model of the array in FEKO for use in future simulations. The Duroid® radome ($\in_r$=2.33, tan δ=0.0004) and the Lexan spacer ($\in_r$=4.2, tan δ=0.001) are represented using the surface equivalence principle (SEP) in FEKO requiring meshing only of the dielectric surfaces. The metallic surfaces are approximated as perfect conductors with zero thickness. The patch connectors are not modeled explicitly but approximated by a Teflon coated wire with a voltage gap source. The shorting posts 7 (as shown in FIGS. 3*d*-2 and 9*d*-2) are also modeled as thin wires since including cylindrical posts did not make an appreciable difference but significantly increased the computational expense. The model only includes dielectric losses since conductor losses were found to be negligible.

TABLE 1

Two patch array antenna parameters

| Layer Description | Dimensions and Substrate Thickness (in) |
|---|---|
| Antenna (radome) cover (RT/Duroid 5880) | 4.27 (L) × 2.61 (W), 0.093 thickness |
| Spacer ring (Lexan material) between the antenna cover and ground plane | 4.27 (L) × 2.61 (W) 0.250 thickness 0.250 (W) |
| Patch (Copper) | 1.27 (L) × 0.89 (W) |
| Air-Gap | 0.106 |
| Brass ground plane | 5.77 (L) × 2.61 (W), 0.125 thickness |

Experimental Results

Figure 4:
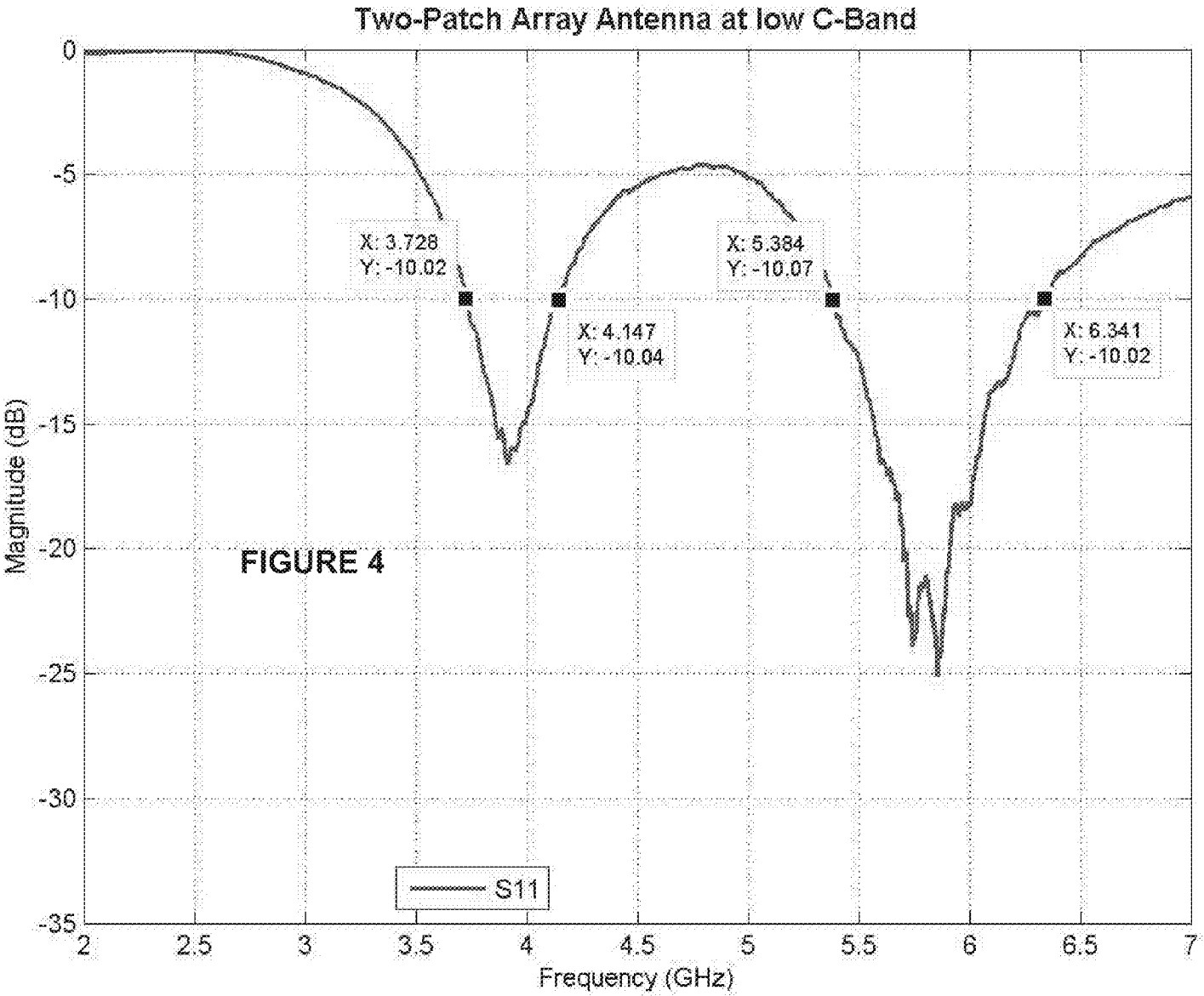
FIG. 4 is a graph showing the frequency versus the magnitude in dB of a two-patch array antenna.

The return loss (RL) data was measured using a network analyzer, Wiltron™ 37269A vector network analyzer (VNA) calibrated using the Wiltron™ K-Cal Kit Model 3652 (www.anritsu.com). The one-port RL measurement includes a two-way power divider to feed the two array elements. FIG. 4 shows the measured return loss of the two-patch array antenna with a power divider. The FEKO® model does not provide the well matched input measured for this array owing to the approximate feed model. See S. J. Weiss, K. Coburn, "An efficient patch antenna with bandwidth enhancement," 2007 *IEEE Antennas and Propagation International Symposium*, pp. 1529-1532, June 2007.

FIG. 4 is a graphical depiction of measured return loss of the two-patch array antenna of a preferred embodiment of the present invention. From FIG. 4, if S11<−10 dB is utilized for the return loss to compute the bandwidth of the antenna, it can be seen that the antenna operates at two resonant frequencies, one at 3.95 GHz and one at 5.8 GHz. FEKO obtains the lower measured resonant frequency at 3 GHz rather than 4 GHz. Referring to the higher resonance frequency (5.8 GHz), the bandwidth at the center frequency of 5.8 GHz is about 957 MHz, which is 17% bandwidth with respect to the center frequency at 5.8 GHz. Conventional pin-fed patch antennas have a narrow bandwidth around 5% at its center operating frequency. Compared to the conventional designs, the preferred embodiment antenna has a bandwidth that is more than 3 times a conventional pin-fed patch antenna design. See S. J. Weiss, K. Coburn, "An efficient patch antenna with bandwidth enhancement," 2007 *IEEE Antennas and Propagation International Symposium*, pp. 1529-1532, June 2007., hereby incorporated by reference. This was attributed to the absence of surface wave modes in the air substrate and the use of a thin Duroid radome.

The gain and radiation patterns were measured in the ARL/Adelphi Laboratory Center tapered anechoic chamber. The radiation pattern and gain measurements were conducted using a C-band Standard Gain Horn (SGH) antenna as the system transmitter and setting up a prototype of the preferred embodiment two-patch array antenna on a non-metallic rotating mast to serve as the receiver.

Two identical Narda SGH antennas (one for transmitter and one for receiver) with a known gain relative to an isotropic radiator (dBi) over the rated bandwidth were used for the reference measurement. The received power versus frequency for the SGH was measured and then replaced with the antenna under test to calibrate the pattern data with an error of ±0.1 dB. The receive pattern for the radiating antenna was measured versus angle with the error estimated from the repeatability of the data after repositioning the antenna. It was recognized that the repeatability error can be minimized with careful procedures and placement of the antenna on the rotating pylon but it is not negligible, typically ±0.25 dB and so dominates the experimental error for gain versus angle data.

Figure 5:
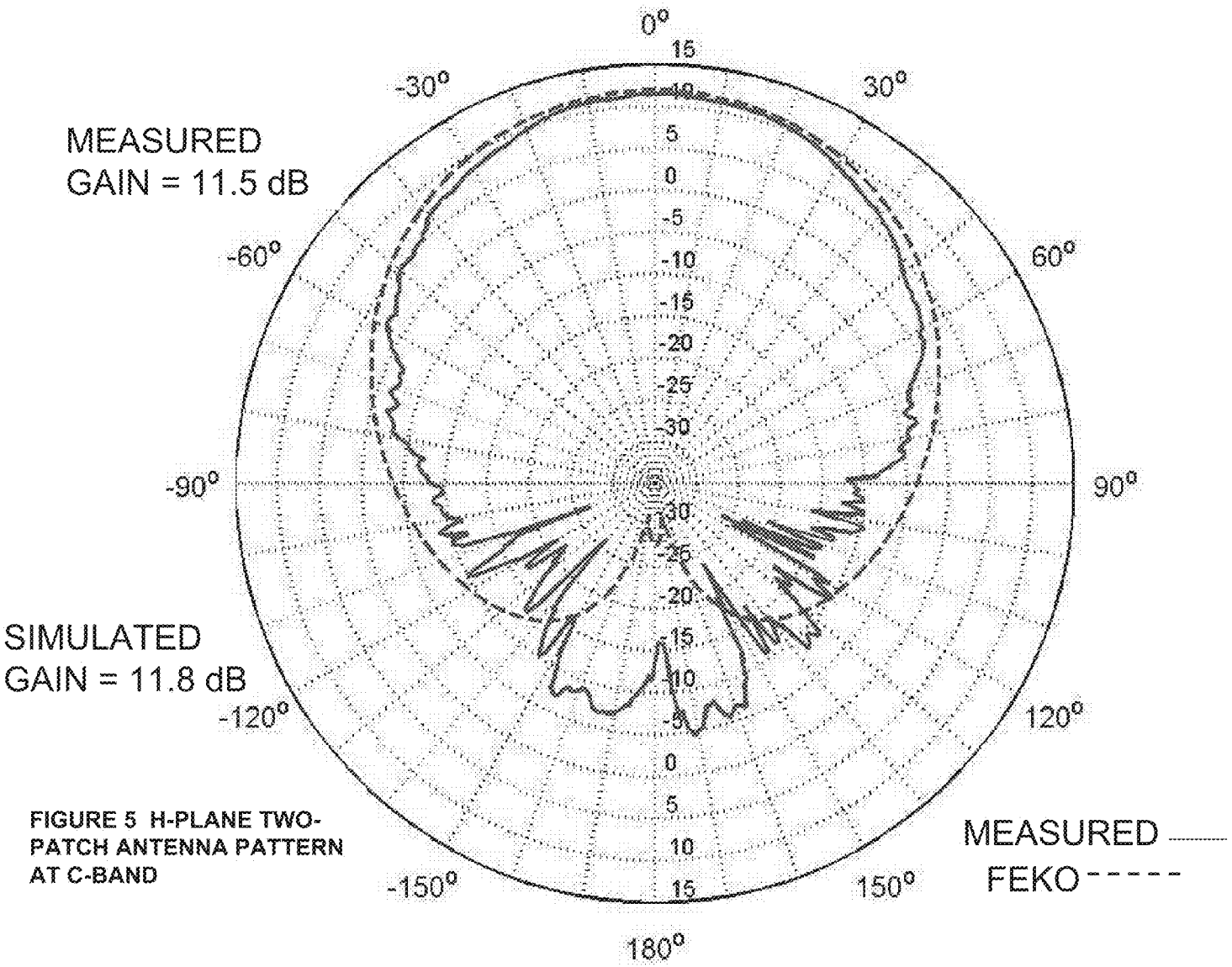
FIG. 5 is a graphical presentation of the H-Plane two-patch array antenna pattern at C-band.
Figure 6:
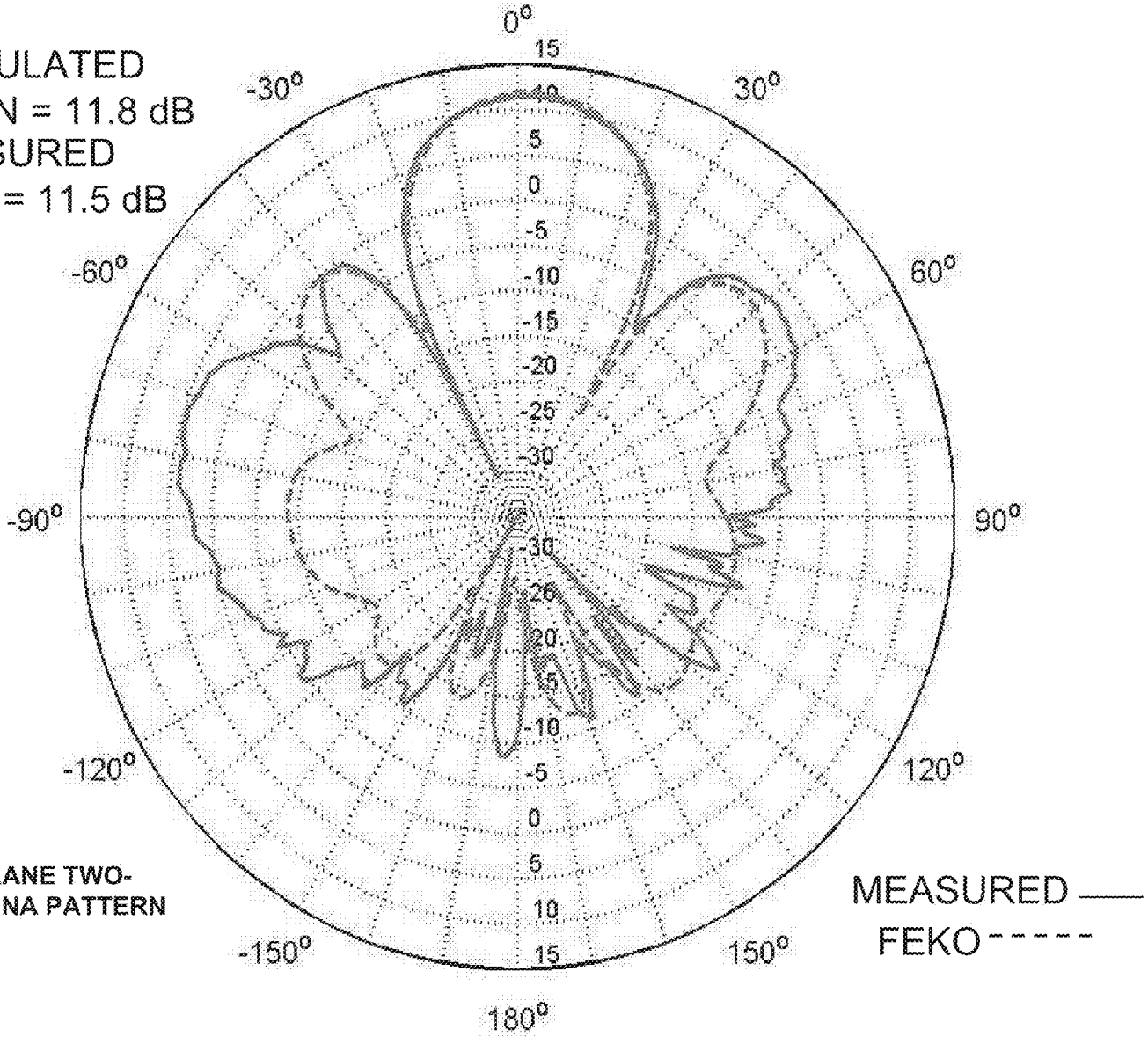
FIG. 6 is a graphical representation illustrating radiation patterns in the E-plane of a preferred embodiment two-patch array antenna with measured performance at 5.8 GHz compared to the model results using FEKO (www.feko.info), EM simulation software.
Figure 10:
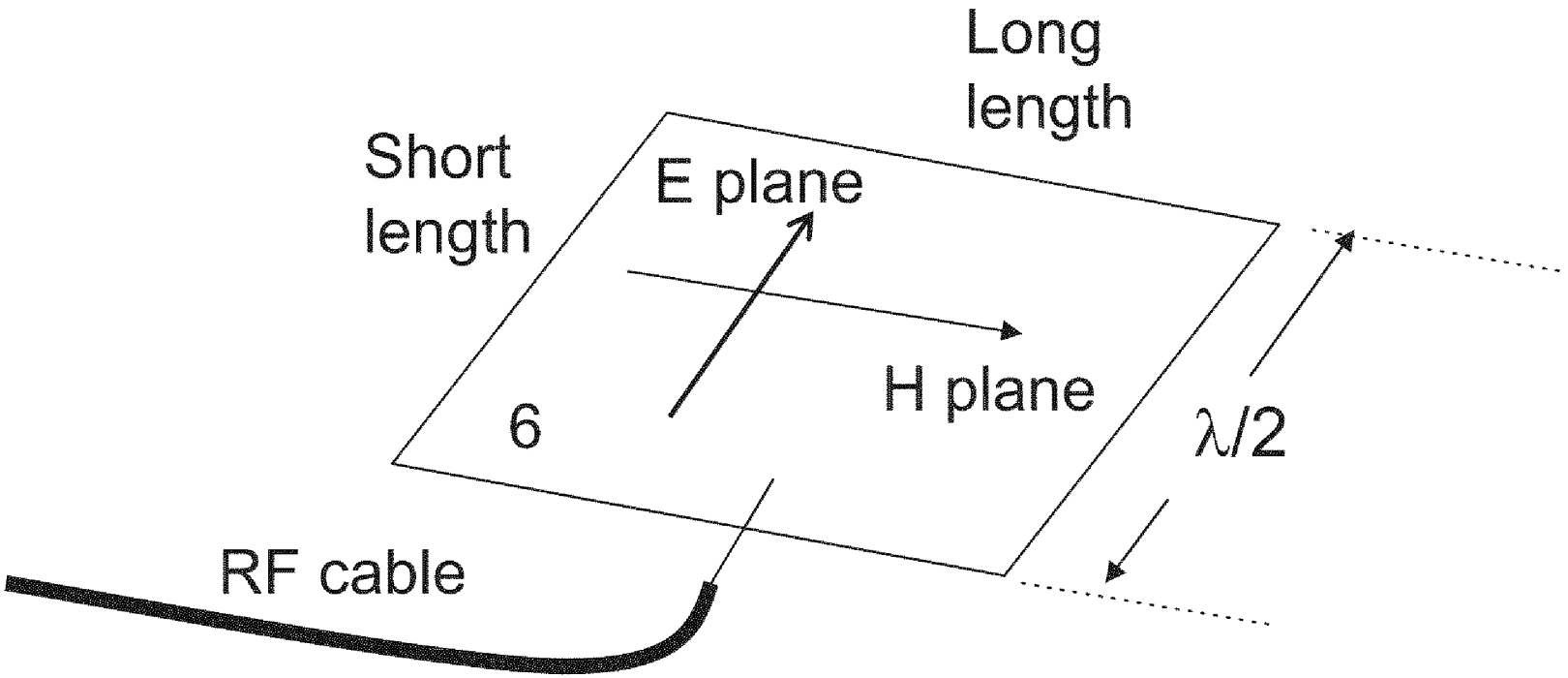
FIG. 10 is a schematic illustration of the attachment of the RF cable to a patch 6 showing the E-plane and H-plane orientations.

FIGS. 5 and 6 are graphical representations of the H-Plane and E-plane radiation patterns at C-Band of a preferred embodiment two-patch array antenna measured at 5.8 GHz compared to the model results. FIG. 5 shows radiation patterns in H-plane of a preferred embodiment two-patch array antenna with measured performance at 5.8 GHz compared to the model results using FEKO (www.feko.info), EM simulation software. FIG. 6 is a graphical representation illustrating radiation patterns in the E-plane of a preferred embodiment two-patch array antenna with measured performance at 5.8 GHz compared to the model results using FEKO (www.feko.info), EM simulation software. The antenna design of a preferred embodiment has the expected patterns at 5.8 GHz with the realized gain of 11.5 dBi including 0.6 dB cable and splitter insertion loss, whereas FEKO obtains 11.8 dBi with a more idealized pattern. FIG. 10 illustrates the directions of the E and H planes.

The C-band patch array embodied in the preferred embodiment of FIGS. 1 and 2 was designed to operate at frequencies between 5.0 and 6.5 GHz with broad azimuthal (H-plane) beamwidth. Additionally, the patch array operates at a lower frequency band centered about 3.95 GHz. The design focuses on a resonant frequency, $f_r$=5.8 GHz corresponding to a free-space wavelength, $\lambda_0$=2.03 in. The goal in the antenna design was to maximize the return loss bandwidth. The antenna design is shown in FIGS. 1 and 2 with the detailed dimensions and substrate layer properties listed in Table 1. The relative dielectric constant of the antenna cover is, $\in_r$=2.33, to represent Rogers RT/Duroid® 5880 low-loss dielectric (www.rogerscorporation.com).

The antenna described in the foregoing has high power microwave (HPM) applications as well as other applications such as wireless cellular phone, wireless router repeater, and many other applications. The antenna design of the preferred embodiments uses an air substrate as opposed to dielectric materials. The results indicate that the antenna has greater bandwidth compared with the conventional pin-fed patch antennas. The array design maintains high antenna efficiency and high power handling, making it attractive for HPM system development.

Figure 7:
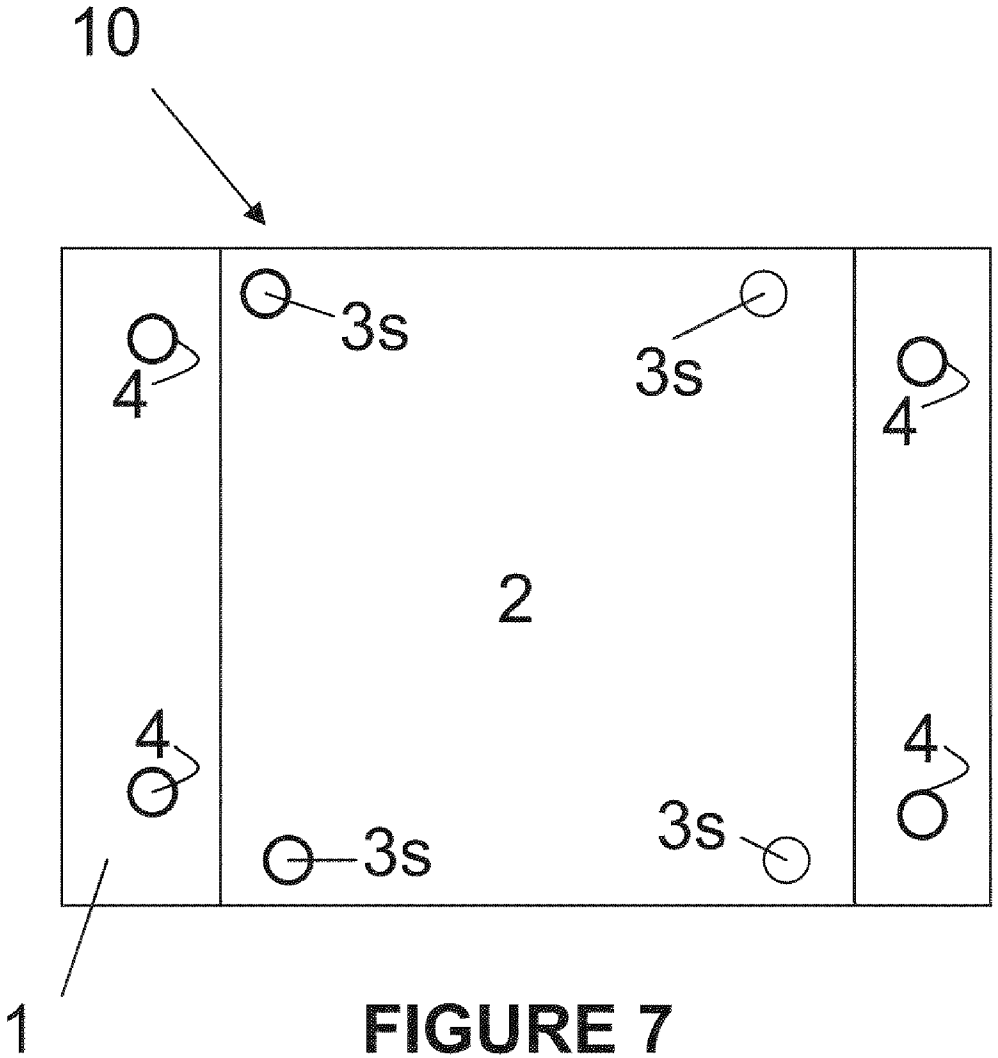
FIG. 7 is a front view of a one-patch antenna embodiment of the present invention.
Figure 8:
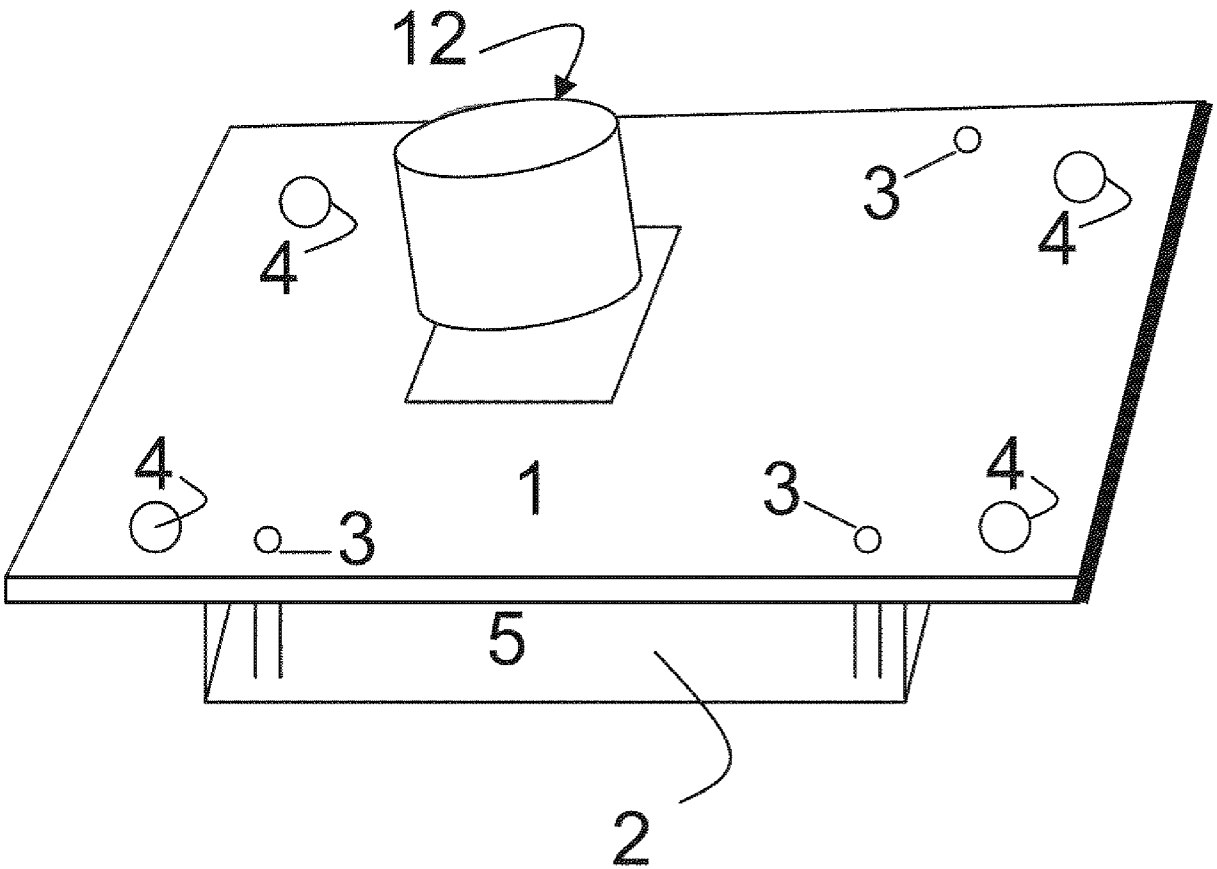
FIG. 8 is a side back view of a one-patch antenna embodiment of the present invention.

FIGS. 7 and 8 illustrate a single patch design of a preferred embodiment antenna system having a radiated gain of 8.7 dBi (Decibel isotropic).

FIGS. 7, 8 and 9 show the front, the back and the inside details of the single patch antenna system. FIG. 7 shows the side front view of the system including the ground plane plate 1 (which may be, for example, brass) with four holes 4 for mounting the system on a platform, and the antenna cover 2 secured with four nylon screws 3*s*. FIG. 8 shows the side back view of the antenna including a type N connector 12 that may be connected to a high power RF source (>1 Kilowatt in power). FIG. 9 is a composite illustration of the detailed assembly antenna architecture 10. FIG. 9 consists of FIGS. 9*a*, 9*b*, and 9*c*.

Figure 9A:
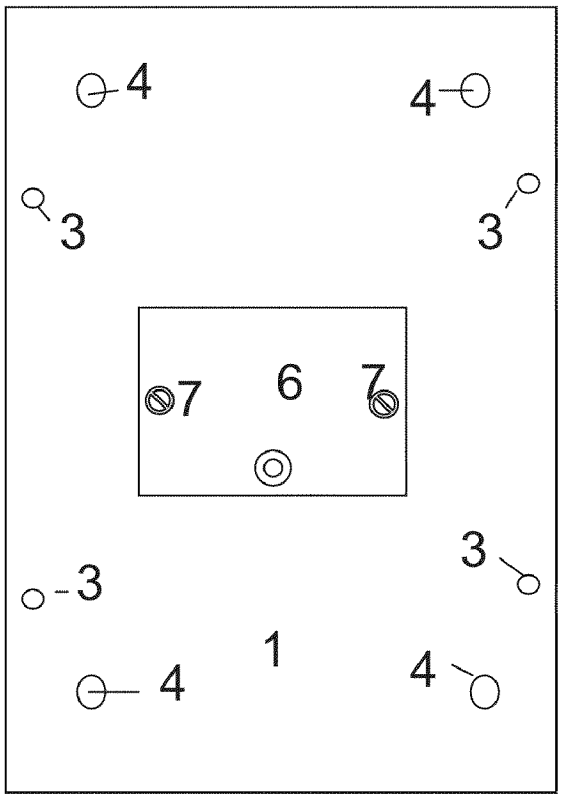
FIG. 9*a* depicts the ground plane base 1 for the one-patch antenna. The detailed dimensions for ground plane and the patch are shown in FIGS. 9*a*-1 and 9*a*-2.
Figures 1, 9A:
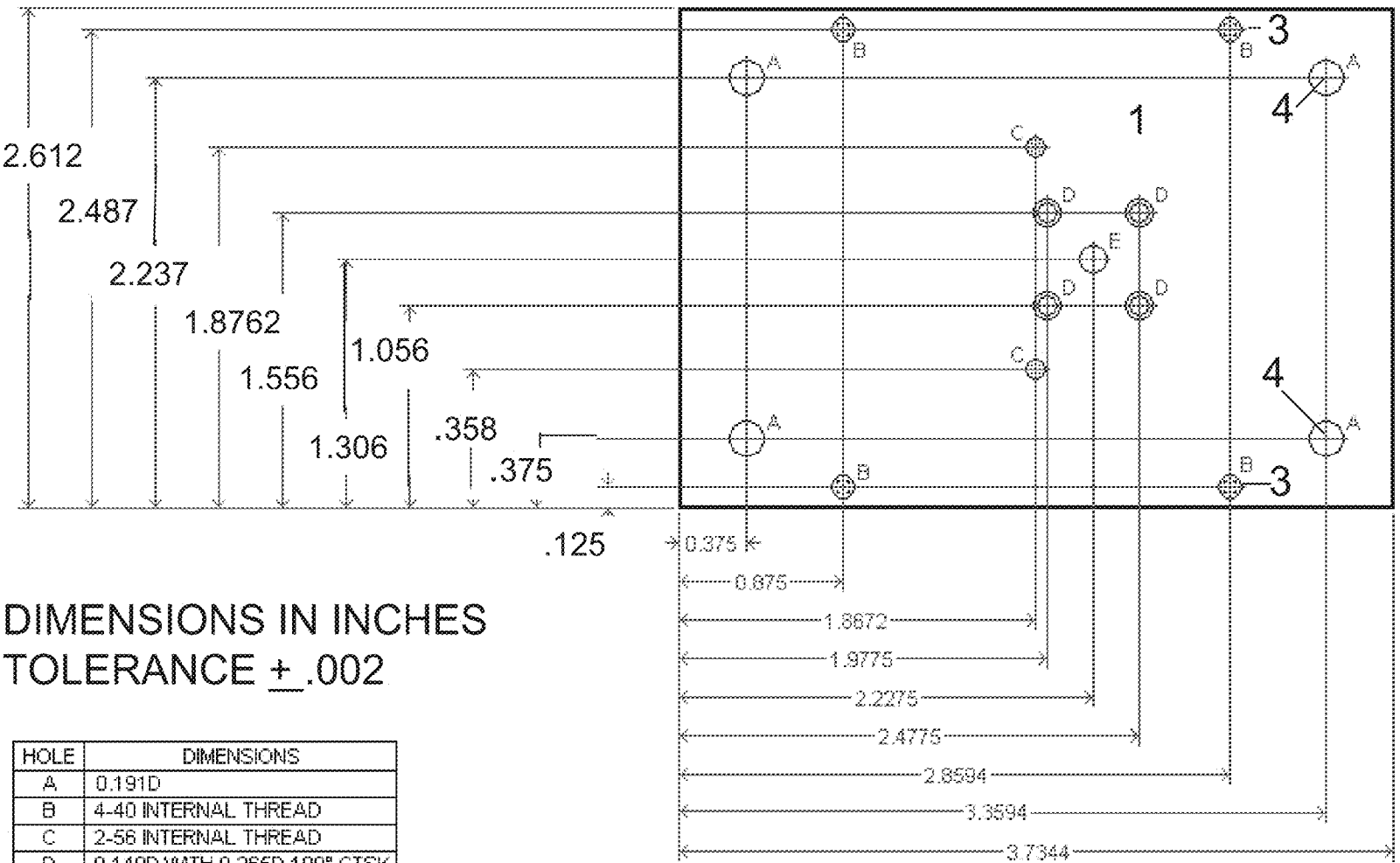
Figures 2, 9A:
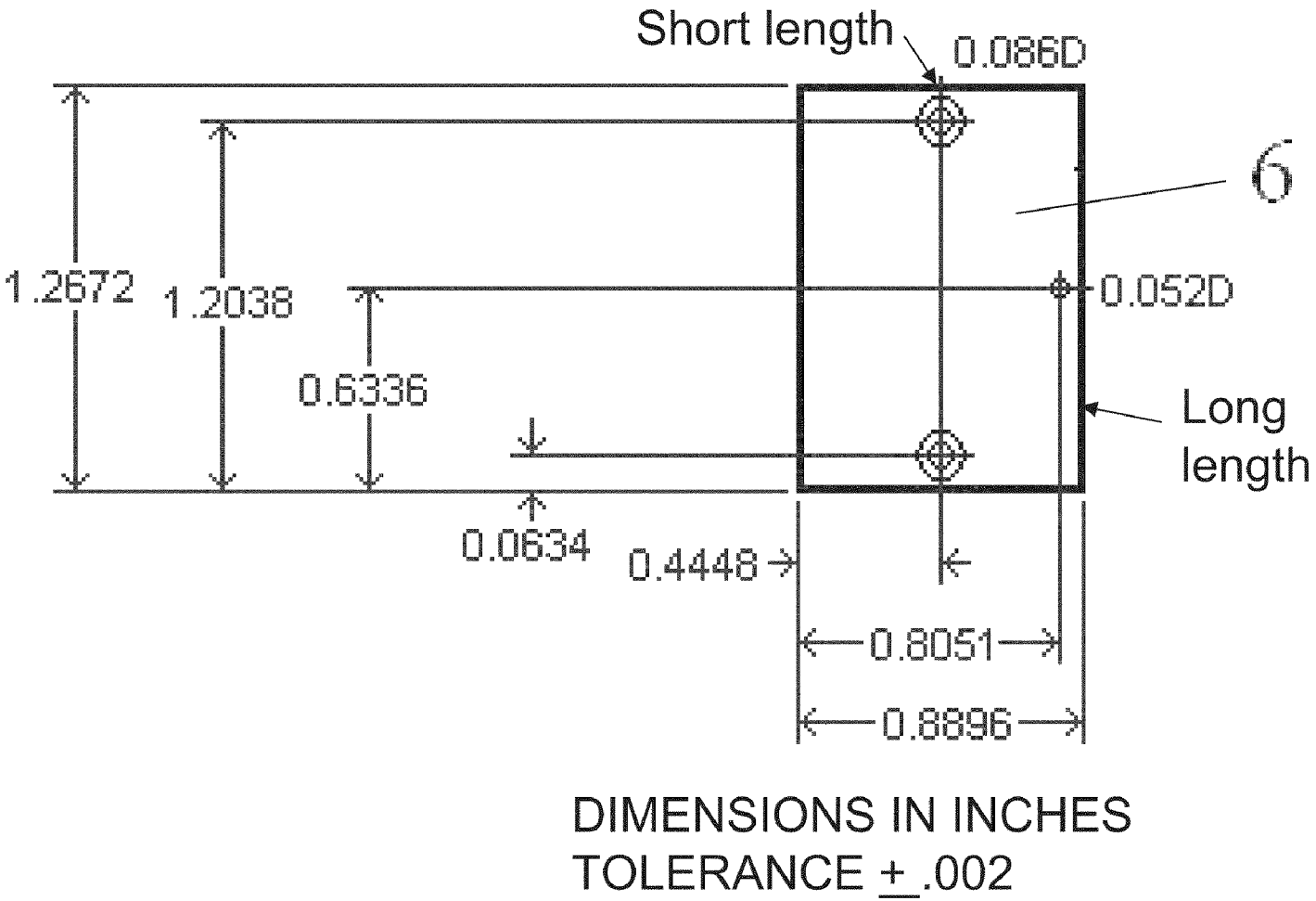
Figures 1, 9B:
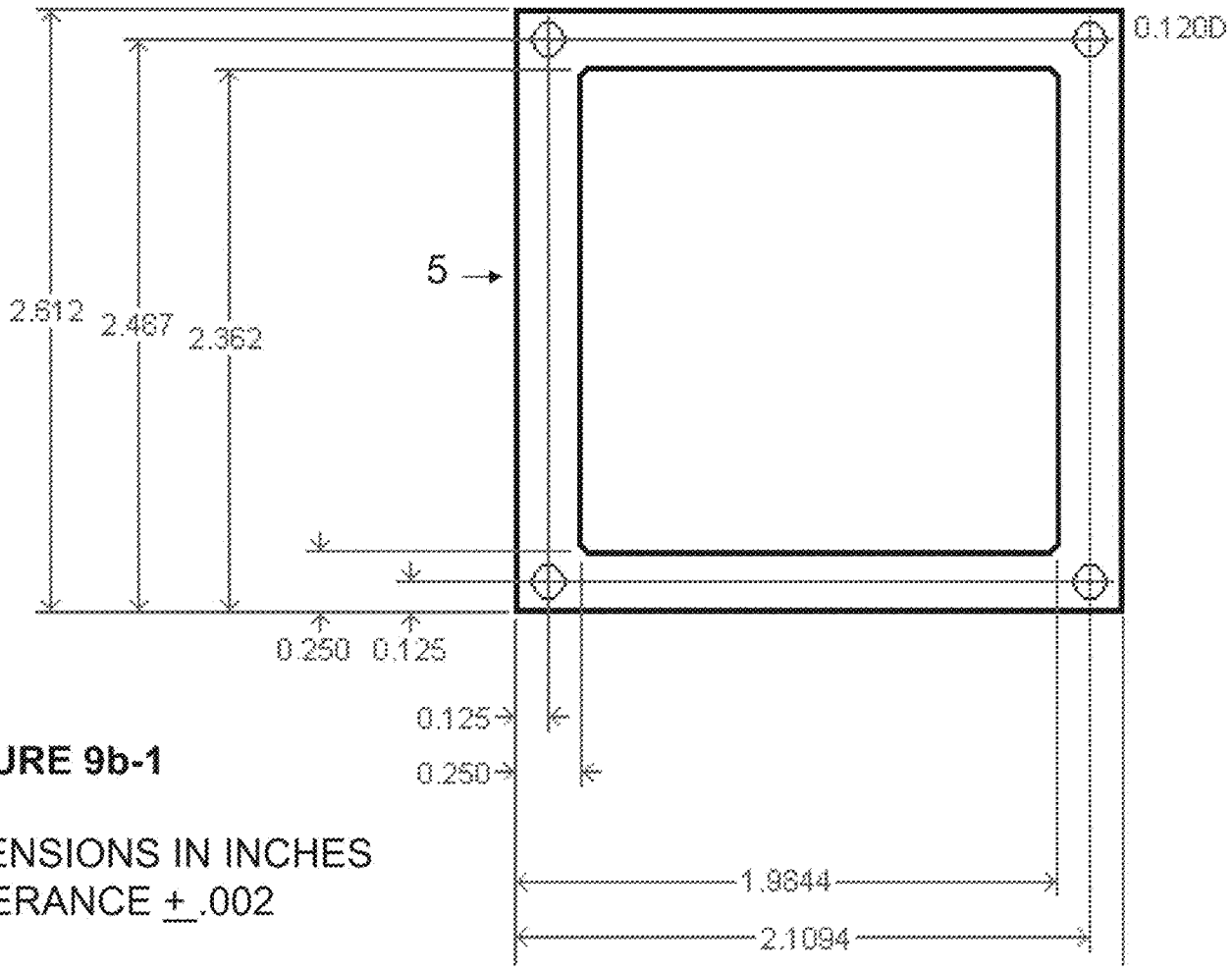
Figures 1, 9C:
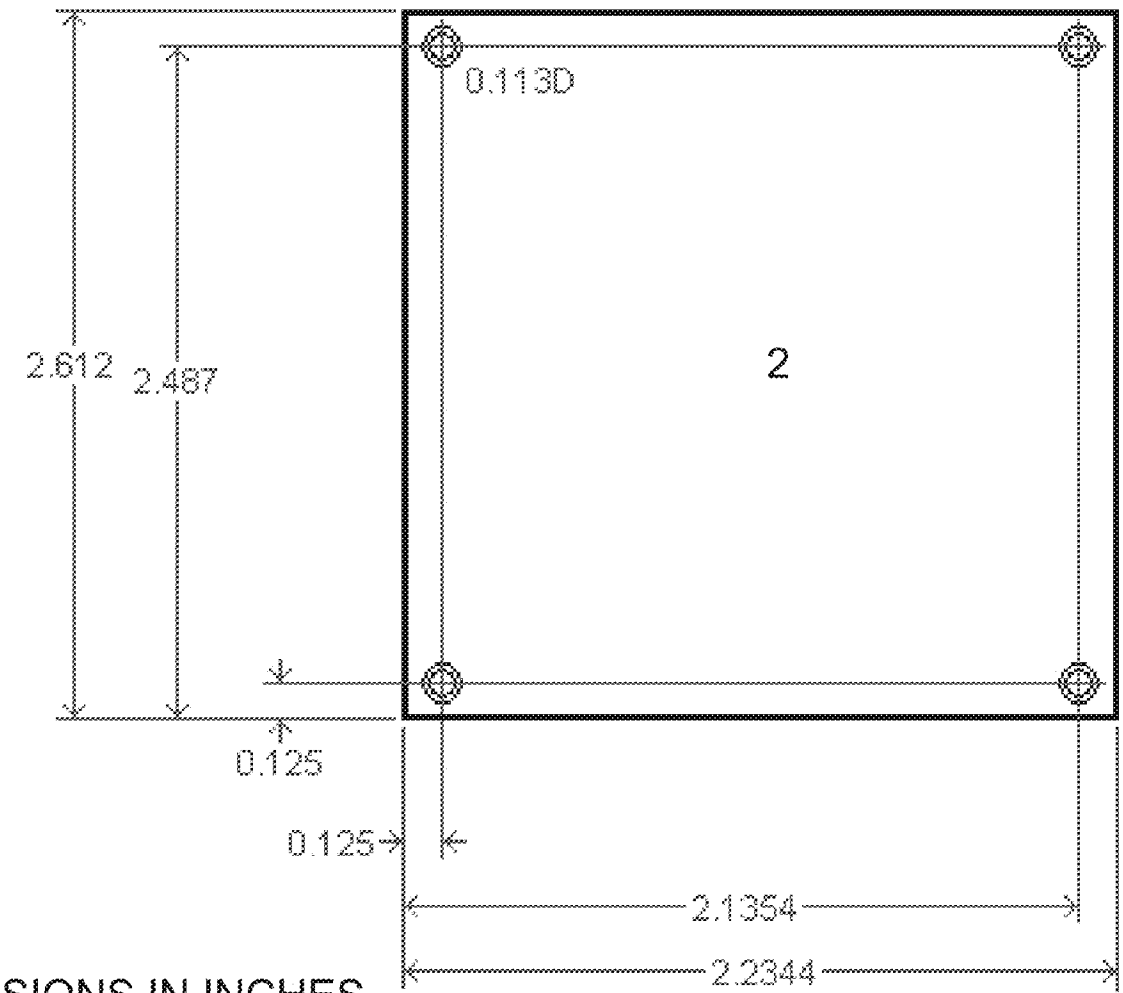
Figures 1, 9D:
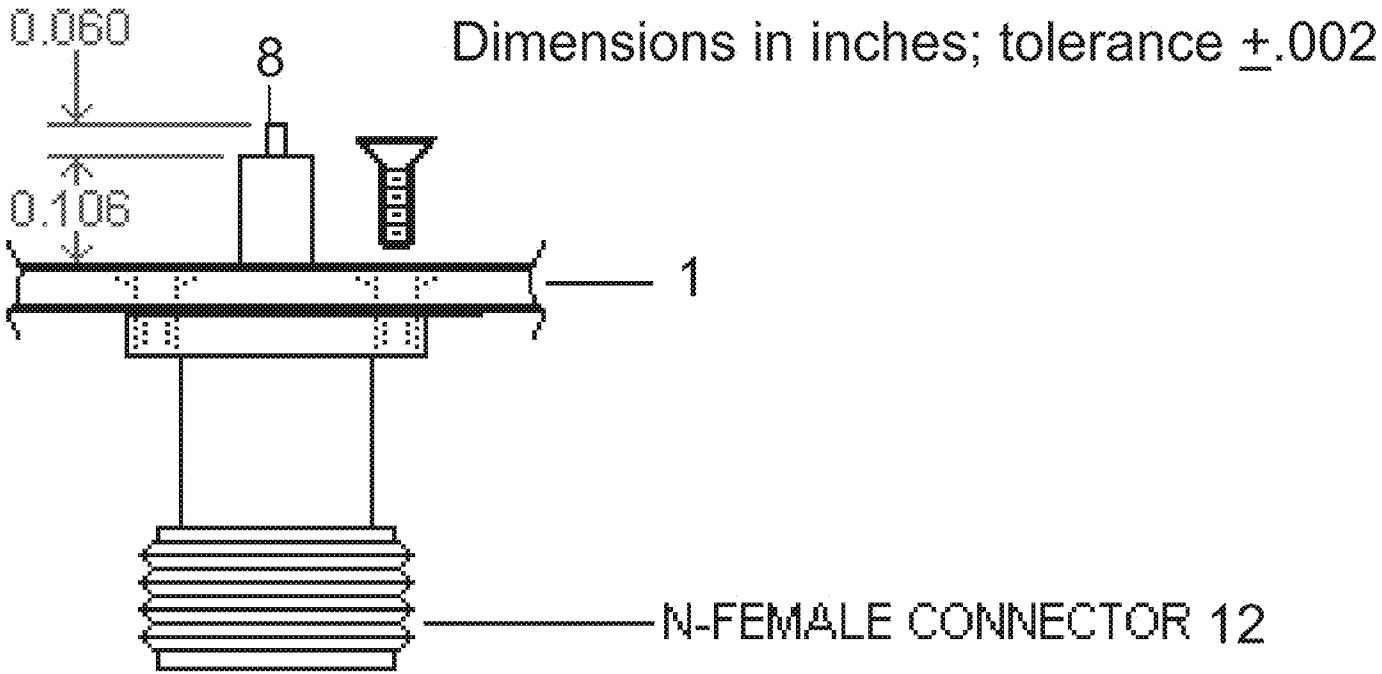
Figures 2, 9D:
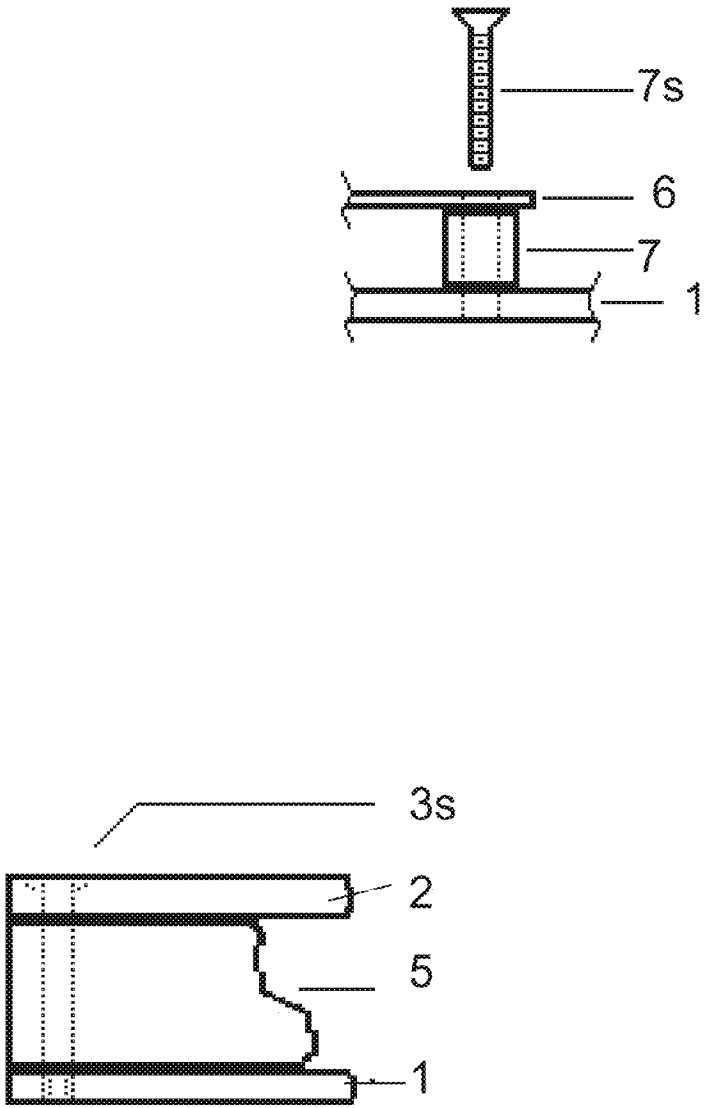

FIG. 9*a* depicts the ground plane base plate 1 with four big mounting holes 4, four small holes 3 securing the antenna cover 2. The one type N connector 12 is illustrated in FIG. 9*d*-1. This ground plane base plate 1 supports a rectangular patch 6 as shown in FIG. 9*d*-2. The patch is supported by two metal posts 7 secured by screws 7*s* and is excited by a pin-feed probe, as illustrated in FIG. 10. The publication "An Efficient Patch Antenna with Bandwidth Enhancement," (hereby incorporated by reference) by Steven J. Weiss*, Keefe Coburn. The Army Research Lab, Adelphi, MD, IEEE Xplore 2.0, pp. 1529-1532, published Jun. 9-15, 2007, explains the function of the posts for a single element. The detailed dimensions for ground plane base plate 1 and the patch 6 are shown in FIGS. 3*a*.1 and 3*a*.2.

FIG. 9*b* illustrates the spacer 5 which may be approximately ¼ (0.25) inch and may be, for example, be formed of clear polycarbonate such as Lexan. Spacer 5 is placed between cover and the ground antenna plane base 1. The height of the plastic spacer 5 is adjusted minimize the loading effects of the dielectric cover on the patch. It also may be used tune the resonant frequency of the antenna. The distances in length and width between the patches to the walls of the spacer were experimentally optimized for optimal performance. The detailed dimensions of the spacer 5 are shown in 9*b*-1.

FIG. 9*c* shows the antenna cover 2 made of Duroid material (RT 5880), and four black nylon screws 3*s* which are used to secure the cover 2. The detailed dimensions of the cover 2 are shown in FIG. 9*c*-1. FIG. 9*a*-2 illustrates a patch 6 which may preferably be formed of an alloy 260 half hard brass 0.04 inches thick; preferably with a maximum flatness tolerance of ±0.0005 corner to corner.

The advantages of the single and two-patch antenna assemblies of the present invention over conventional antenna designs is the ability to efficiently transmit high power signals. A normal patch array antenna, designed with a dielectric material, has about 80% efficiency. The factors that determine the patch array antenna efficiency include the loss in dielectric material, the surface wave loss, and conduction losses. For example, if the patch array antenna, designed on dielectric, is excited with a power of 1 Kilowatt, the antenna radiate 800 watts 200 watts are lost. In contrast, the high power single patch and two-patch antennas constructed in accordance with the principles of the present invention, without using dielectric material, have very high efficiency (on the order of 97%.). As such, only 30 watts are lost (due to metal conduction.) Therefore, developed systems from this invention have a significant impact for an integrated antenna array into various platforms, as well as for wireless communications, wireless networks, and satellite communication systems for commercial use.

In addition, the design features of the preferred embodiments of the present invention permit low visibility with a low-profile architecture. A conventional horn antenna has high visibility and does not have a low-profile architecture. In particular, the conventional antenna is not easily mounted on vehicles and other suitable platforms. In contrast, single patch or two-patch array antenna has a low profile and is adapted for use on a vehicle.

The patch array antennas constructed in accordance with the principles of the present invention can have potential uses for both commercial and non-commercial applications. In particular, it may be used to neutralize improvised explosive devices, wireless communication in the battle field, and other uses.

Possible commercial uses include High Power Microwave (HPM) systems to couple energy into electronics, potential uses in wireless cellular phone(s), internet routers, and internet repeaters for extending range of a wireless network. The preferred embodiments of the present invention can also be used for Wi-fi communication systems or devices.

This dual-C-band low-profile, small size as well as high power single element and two-patch array antenna is developed for high power applications and wireless communication systems. In particular, the two elements of the array are suspended by supporting metal posts to increase the array antenna efficiency. These elements are separated at prescribed distance and metal posts at precise locations for obtaining electrical performance in terms of antenna pattern and gain.

The relative measurements are based the following equation:

$$W_1 \times f_1 = W_2 \times f_2$$

Where Wi (i=1, 2), fi are the short length of a patch of the array, and operating frequency, respectively. For example, in a preferred embodiment of the invention, the short length $W_1$ of a patch is 0.89 in and the desired frequency $f_1$ is 5.8 GHz. In order to determine the calculated value of the short length ($W_2$) for a desired frequency $f_2$ of 7.2 GHz, the following calculations are made:

$$0.89 \times 5.8 = W2 \times 7.2$$

The result is $W_2$=0.717 inch, which correlates to the relative measurement for the short length of a patch for a frequency of 7.2 GHz.

Similarly, the parameters of the patch are also determinative of the bandwidth and resonant frequency of the antenna. Specifically, the length (L) of the patch is used to determine the bandwidth of the antenna, and the short length (W) is used for the resonant frequency determination. The typical ratio of (L/W) is about 1.5, in this case, (L/W)=(1.27/0.89)=1.427. In addition the two support metal posts on the patch are shorted for the bandwidth enhancement. The bandwidth of the antenna in the invention is more than 3 times compared to the traditional patch antenna designed with dielectric material.

As used in the following claims, the terminology "patch antenna" is an antenna which uses a patch, for example, a half-wavelength-long patch, and a larger ground plane, for which radiation is produced by the "radiating slots" at top and bottom, or equivalently as a result of the current flowing on the patch and the ground plane. As used herein, the terminology RF means radiofrequency.

Connector 12 as shown in FIG. 3*d*-1 may be connected to a high power RF (radio frequency) source. The high power RF source may be greater than 1 Kilowatt in power. Optionally, an outer cover (not shown) may enclose the other elements of system in a manner well known to those of ordinary skill in the art. The outer cover may be of metal, plastic, or any other material capable of enclosing the other elements of system. Preferably, outer cover is impervious to the environment. As shown in FIG. 3*c*-1 an antenna cover 2 may preferably be made of a doped TEFLON® composition, e.g. DUROID® made by the Rogers Corporation. However, antenna cover 2 may be made of another non-metallic material capable of enclosing the elements of system. Antenna cover 2 may be adapted to fit within an outer cover. The outer cover is further described in U.S. patent Ser. No. 12/178,771, filed on Jul. 29, 2008, which is hereby incorporated by reference as though fully rewritten herein. The outer cover may include flanges having a plurality of holes that allow system be mounted onto a platform. As described in U.S. patent Ser. No. 12/178,771, a two-way high power divider (described with respect to FIG. 3e in U.S. patent Ser. No. 12/178,771), a ground plane 1, two patches (described below with respect to FIG. 3*d*), and a spacer (described below with respect to FIG. 3*b*) may all sandwiched between an outer cover and antenna cover 2. A rim running around the inner edge of outer cover 110 may hold all the elements in place.

FIG. 3*c*-1 is a schematic of antenna cover 2. While specific dimensions are given in the figure, antenna cover 2 can be of any dimension or shape. Antenna cover 2 may be secured to an optional outer cover using screws, rivets, bolts or other fasteners through holes in antenna cover 2. While FIG. 3*c*-1 shows 6 holes, any number of screw holes may be used. Additionally, antenna cover 2 may be secured to an outer cover (not shown) via adhesive, clips, locking devices, or any other means known in the art. The seal between the antenna cover 2 and an optional outer cover may be air-tight and/or water-tight.

FIG. 3*b*-1 is a schematic of a spacer 5. While specific dimensions are given in the figure, spacer 5 can be of any dimension or shape. Spacer 5 may be secured between antenna cover 2 and an optional outer cover using screws, rivets, bolts or other fasteners through holes in spacer 5. While FIG. 3*b*-1 shows 6 holes, any number of screw holes may be used. Spacer 5 is preferably made of a thermoplastic resin, such as a polycarbonate, e.g. as LEXAN® made by SABIC Innovative Plastics. However, spacer 5 can be made of any non-conducting material, including but not limited to plastics, glass, fibers, etc.

Spacer 5 is positioned between antenna cover 2 and ground plane base 1. Spacer 5 has a void in its center into which patches 6 may fit. Spacer 5 is preferably ½ inch high, however it can be of any height, including, but not limited to, ¼ inch, ⅓ inch, ⅔ inch, ¾ inch, and one inch. The height of spacer 5 may be chosen to minimize the loading effects of the dielectric cover on the patches.

FIG. 3*a*-1 is a schematic of ground plate base 1. While specific dimensions are given in the figure, as exemplary of the best mode know to the inventor, ground plate 1 can be of any dimension or shape. Ground plate 1 may be secured between antenna cover 2 and an optional outer cover outer cover using screws or bolts through holes in ground plate base 1. While FIG. 3*a*-1 shows ten screw holes, any number of screw holes may be used. Ground plate base 1 may be made of any conducting material. Ground plane base 1 as shown in FIG. 3*a*-1 supports two patches 6. Ground plane base 1 shown in FIGS. 8 and 9*a* supports one patch 6.

FIGS. 3*a*-2 and 9*a*-2 are schematic illustrations of patches 6. Patches 6 may be supported from ground plane 1 by posts. Preferably, the patches are made from Alloy 260 half-hard brass 0.04 inches thick with a maximum flatness tolerance ±0.0005 corner to corner. Preferably, each patch 6 may be supported by two posts 7 as shown in FIGS. 3*d*-2 and 9*d*-2 located at positions 7 in FIGS. 3*a* and 9*a*. However any number of posts 7 may be used to support patch(s) 6. The posts 7 may be made of metal, plastic or any other materials know in the art. Furthermore, the posts may be held in place by bolts 7*s*, clips, adhesive, or any other method known in the art. Additionally, each patch 6 may be coupled to a pin-feed probe 8 as shown in FIG. 3*d*-1. Pin-feed probes excite patches 6 and may be coupled adjacent to an edge of patch 6 other than locations 8 shown in FIGS. 3*a* and 9*a*.

Patches 6 are preferably separated by a distance of 1.27864λ, where λ is the operating wavelength of system 10. However, patches 6 may be separated by any distance, including, but not limited to, 1λ 1.1λ, 1.2λ, 1.3λ, 1.4λ, and 1.5λ. Furthermore, patches 6 may be placed at a location separated from spacer.

Shown in U.S. patent application Ser. No. 12/178,771, hereby incorporated by reference, is an image of a two-way high power divider 390 with two right angle male-to-male connectors 395. The connectors 395 are connected to the pin-feed probes coupled to each patch 380; which correlate to the connectors 12, pin-feed connection 8 and patches 6, respectively, of the present application.

It should be apparent that embodiments other than those specifically described above may come within the spirit and scope of the present invention. Hence, the present invention is not limited by the above description.

The invention claimed is:

1. A patch antenna comprising:

a base extending in a first plane;

at least one patch mounted in a plane substantially parallel to the first plane; the at least one patch being spaced from the base by at least two metallic posts such that the base and the at least one patch are spaced apart with substantially only gaseous fluid therebetween;

the at least one patch having at least one dimension in the range of approximately 0.8906 to 0.8886 inch;

at least one power source operatively connected to the at least one patch for generation of electromagnetic waves at a center frequency of approximately 5.8 Gigahertz.

2. The patch antenna of claim 1 which both receives and transmits and wherein the gaseous fluid is air.

3. The patch antenna of claim 1 wherein the thickness of the at least one patch is approximately 0.04 inch.

4. The patch antenna of claim 3 wherein the patch comprises brass with a maximum flatness tolerance of ±0.0005 inch corner to corner.

5. The patch antenna of claim 1 further comprising a cover and wherein cover is spaced apart from the base by at least one second spacer made of polycarbonate.

6. The patch antenna of claim 1 wherein the capacity of the RF power source is greater than 1 kilowatt and the radiated gain is approximately 8.7 dBi.

7. The patch antenna of claim 1 wherein the at least one patch comprises two patches separated by approximately 1.27 λ, where λ is the operating wavelength.

8. The patch antenna of claim 1 wherein the at least one patch comprises two patches with a separation in the range of 1 to 1.5 λ, where λ is the operating wavelength.

9. The patch antenna of claim 1 wherein the power source a two-way high power divider.

10. A method of neutralizing unattended microwave devices comprising connecting an RF power source to a patch antenna comprising a base extending in a first plane and at least one patch extending in a second plane;

operating the patch antenna at a frequency in the range of approximately 3.89 to 5.85 Gigahertz in the vicinity of a suspected unattended microwave device to thereby jam any communication signal to the unattended microwave device.

11. The method of claim 10 wherein the first and second planes are substantially parallel and the at least one patch is mounted to and spaced apart from the base by at least two metallic posts; whereby the base and the at least one patch are spaced apart with substantially only gaseous fluid therebetween.

12. The method of claim 10 wherein the at least one patch has at least one dimension in the range of approximately 0.8886 to 0.8906 inch.

13. The method of claim 10 wherein the unattended microwave device is a cellular phone which is operatively connected to activate an explosive device and the jamming of any communication signal to the unattended microwave device prevents the activation of the explosive device.

14. The method of claim 10 wherein the patch antenna is powered by a power source having a capacity greater than 1 kilowatt.

15. The method of claim 10 wherein the at least one patch comprises two patches separated by a distance of approximately 1.27 λ.

16. A patch antenna comprising:

a base extending in a first plane;

at least one patch mounted in a plane substantially parallel to the first plane; the at least one patch being spaced from the base by at least two metallic posts such that the base and the at least one patch are spaced apart with substantially only gaseous fluid therebetween;

the at least one patch having at least one dimension in the range of approximately 0.716 to 0.718 inch;

at least one power source operatively connected to the at least one patch for generation of electromagnetic waves at a center frequency of approximately 7.2 GHz.

17. The patch antenna of claim 16 wherein the at least one patch comprises two patches separated by a distance of approximately 1.27 $\lambda$.

18. The patch antenna of claim 16 wherein the thickness of the at least one patch is approximately 0.04 inch.

19. The patch antenna of claim 16 which both receives and transmits and wherein the gaseous fluid is air and wherein the patch antenna may be mounted to a motor vehicle.

20. The patch antenna of claim 16 wherein the power source a two-way high power divider.

* * * * *